United States Patent [19]

Iizuka et al.

[11] Patent Number: 5,074,693

[45] Date of Patent: Dec. 24, 1991

[54] MAKEUP LIQUID CONTAINER WITH APPLICATOR AND STIRRER

[75] Inventors: Shigeo Iizuka; Hiroyuki Nakamura; Takao Kishi; Syuzo Endo, all of Tokyo, Japan

[73] Assignee: Yoshino Kogyosho Co., Ltd., Tokyo, Japan

[21] Appl. No.: 605,487

[22] Filed: Oct. 30, 1990

Related U.S. Application Data

[62] Division of Ser. No. 283,843, Dec. 13, 1988, Pat. No. 4,984,918.

[30] Foreign Application Priority Data

| | | | |
|---|---|---|---|
| Jan. 29, 1988 | [JP] | Japan | 63-10721[U] |
| Jan. 29, 1988 | [JP] | Japan | 63-10722[U] |
| Feb. 1, 1988 | [JP] | Japan | 63-12410[U] |
| Feb. 3, 1988 | [JP] | Japan | 63-13376[U] |
| Sep. 1, 1988 | [JP] | Japan | 63-115206[U] |

[51] Int. Cl.[5] ..... A46B 11/00

[52] U.S. Cl. ..... 401/4; 401/129

[58] Field of Search ..... 401/4, 175, 129

[56] References Cited

U.S. PATENT DOCUMENTS

| | | | |
|---|---|---|---|
| 1,944,067 | 1/1934 | Collins | 401/175 |
| 2,631,826 | 3/1953 | Wolf | 401/4 |
| 2,904,808 | 9/1959 | Massman . | |
| 2,990,834 | 7/1961 | Amen . | |
| 3,085,281 | 4/1963 | Massman . | |
| 3,209,387 | 10/1965 | Lukesch . | |
| 3,336,624 | 8/1967 | Schefer et al. . | |
| 3,456,923 | 7/1969 | Zeuzem . | |
| 4,290,706 | 9/1981 | Wandl . | |
| 4,784,505 | 11/1988 | Dahm . | |

FOREIGN PATENT DOCUMENTS

| | | |
|---|---|---|
| 1073166 | 1/1960 | Fed. Rep. of Germany . |
| 1189683 | 3/1965 | Fed. Rep. of Germany . |
| 1517002 | 3/1968 | France . |
| 2362058 | 3/1978 | France . |
| 1393823 | 5/1975 | United Kingdom . |

*Primary Examiner*—Steven A. Bratlie

*Attorney, Agent, or Firm*—Oliff & Berridge

[57] ABSTRACT

A makeup liquid container with an applicator includes: a container body 1 having a barrel portion 8 and an open neck portion 6; a cap 4 designed to be screwed to the open neck portion 6 of the container body 1; a squeezing sleeve 3 fitted in the open neck portion 6 of the container body 1; and an applicator shaft 5 extended downward from the cap 4 into the container body 1 through the squeezing sleeve 3. A stirrer 9,91 is rotatably disposed in the barrel portion 8 in sliding contact with the inner surface of the barrel portion 8. An engaging device provides a driving connection between the cap 4 and the stirrer 9,91 in such a manner that the stirrer 9,91 is rotated when the cap 4 is rotated in the screwing and/or unscrewing direction and that the driving connection between the cap 4 and the stirrer 9,91 is dismissed when the applicator shaft 5 is extracted from the container body 1.

7 Claims, 17 Drawing Sheets

FIG.16
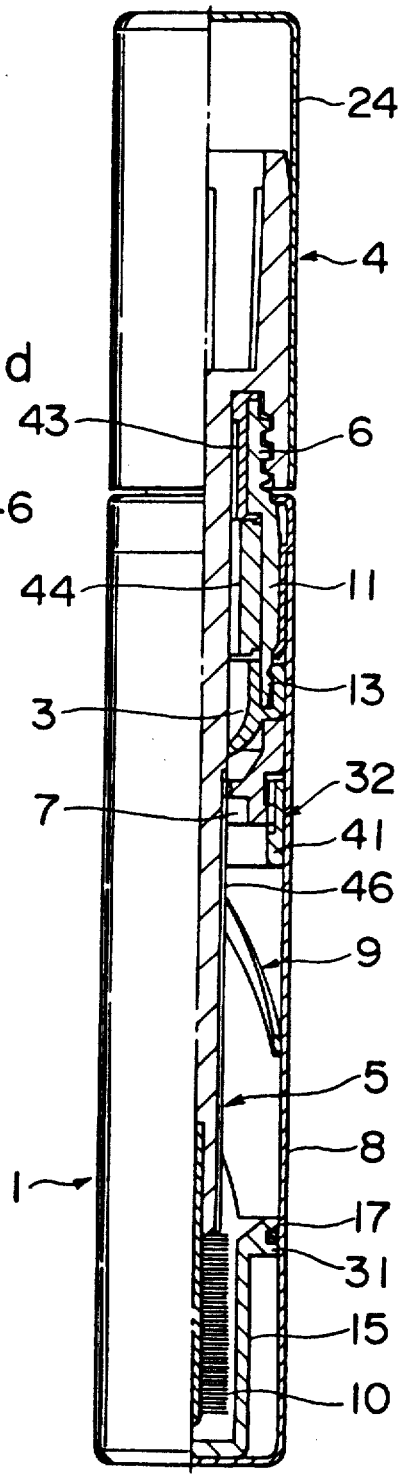
FIG. 15a FIG. 15c
FIG.15b FIG. 15d
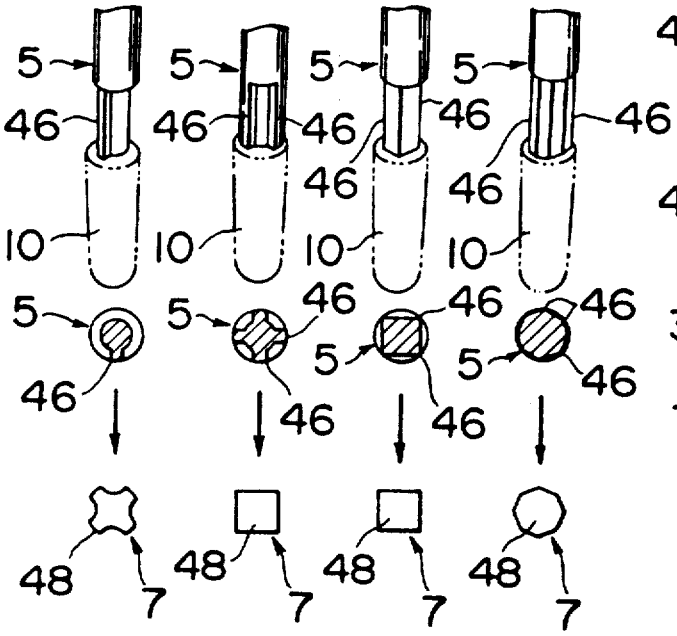

FIG. 27b
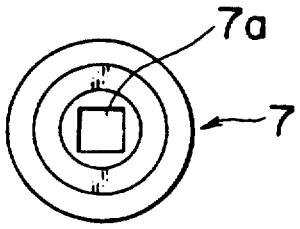
FIG. 27a
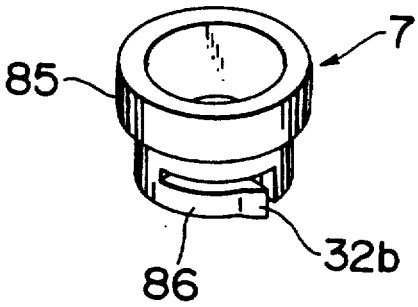
FIG. 27c
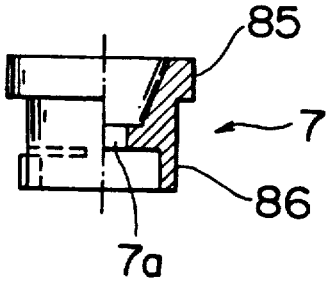
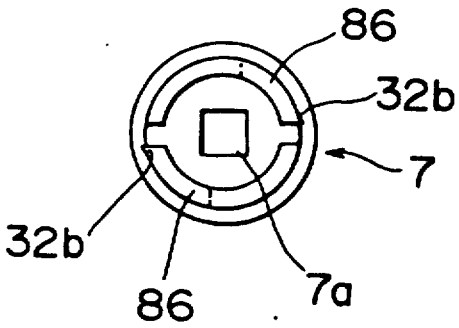
FIG. 27d

MAKEUP LIQUID CONTAINER WITH APPLICATOR AND STIRRER

This is a division of application Ser. No. 07/283,843 filed Dec. 13, 1988 now U.S. Pat. No. 4,984,918.

BACKGROUND OF THE INVENTION

1. Field of the Invention

The present invention relates to a makeup liquid container with an applicator, such as, for example, a mascara liquid container or an eye liner liquid container with a brush or a similar applicator.

2. Description of the Prior Art

In general, a makeup liquid container with an applicator has a container body which contains the makeup liquid, a closure cap, and an applicator such as a brush with a shaft which is fixed to the cap and which is long enough to enable the applicator to reach the bottom of the container body. The end of the applicator therefore is always immersed in the liquid. The user pinches the cap and pulls the applicator out of the container through a squeezing sleeve provided in the opening portion of the container thereby squeezing off any excessive liquid.

Makeup liquids such as mascara and eye liner are usually viscous and tend to attach to the inner-surface of the container body when left for a long time. In consequence, the amount of the liquid which can effectively be used is decreased and, in addition, the thickness of the liquid is changed undesirably.

SUMMARY OF THE INVENTION

Accordingly, an object of the present invention is to provide a makeup liquid container with an applicator, which is improved in such a way as to enable the liquid depositing to the inner surface of the container body to be scraped off thereby overcoming the above-described problems of the prior art.

To this end, according to one aspect of the present invention, there is provided a makeup liquid container with an applicator comprising: a container body having an opened neck portion; a closure cap for closing the opening of the neck portion; an applicator shaft fixed at its one end to the cap such as to extend downwardly therefrom into the container body through a squeezing sleeve provided in the opened neck portion when the cap is placed to cover the opening of the container; an applicator such as a brush fixed to the other end of the applicator shaft; a rotatable stirrer disposed in the container body for rotation in contact with the inner surface of the container body; and rotary drive means for rotating the stirrer to enable makeup liquid to be scraped off the inner surface of the container body.

The rotary actuating means for rotationally actuating the stirrer may include engaging means which enables the stirrer to engage with the cap or the applicator shaft which is integral with the cap and inserted into the container body, such that the stirrer is rotated by the cap or the applicator shaft when the cap and, hence, the applicator shaft are rotated during screwing of the cap onto the open neck of the container body and/or unscrewing of the cap therefrom and such that the stirrer is disengaged from the cap or the applicator shaft automatically when the applicator shaft is extracted from the container body. The rotary actuating means also may be of the type which is capable of rotating the stirrer by means of a rotary actuator exposed on the bottom of the container body.

The stirrer can have a wide variation. For instance, the stirrer may have a cylindrical member provided with a plurality of scraping blades which extend linearly or spirally in the direction of axis of the container body. In another arrangement, the stirrer is composed of a spiral or screw member attached to a rotatable cylindrical member.

When the stirrer has a spiral scraping blade or a spiral member, the makeup liquid can conveniently be scraped downward towards the bottom of the container body when the applicator shaft moves in one direction. However, when the applicator shaft is moved in the reverse direction, the spiral blade or spiral member of the stirrer undesirably causes the makeup liquid on the container wall surface to be moved upward. In order to obviate this problem, it is advisable to provide a ratchet mechanism in the connection between the cap or the applicator shaft and the stirrer such that the stirrer is rotated only when the applicator shaft is moved in one direction, e.g., towards the bottom of the container body A single ratchet, however, may allow the stirrer to rotate due to friction even when this ratchet idles In order to overcome this problem, a second ratchet mechanism which transmits rotation in the direction counter to the direction of transmission of the first ratchet mechanism may be provided between the container body and the stirrer When the rotary actuating means has a rotary actuator exposed to the outside of the bottom of the container body, the arrangement may be such that the above-mentioned rotatable cylinder is exposed so as to constitute the bottom of the container body so that the user can directly rotate the stirrer. The rotary actuator also may be a bottom cap engaging with the rotatable cylinder is provided so as to close a bottom opening of the container body.

BRIEF DESCRIPTION OF THE DRAWINGS

FIGS. 6(*b*) and 6(*c*) are perspective views of stirrers having different forms of blades used in the third embodiment;

FIGS. 15(*a*), 15(*b*), 15(*c*) and 15(*d*) are illustrations of different forms of vertical spline type engaging means for providing engagement between an applicator shaft and a rotatable cylinder in the seventh embodiment;

FIG. 16 is an elevational view of an eighth embodiment of the makeup liquid container with applicator in accordance with the present invention, with a half part thereof shown in section;

DESCRIPTION OF THE PREFERRED EMBODIMENTS

The present invention can be carried out in various forms each of which can be embodied in various preferred ways. Description of preferred embodiments, therefore, will be commenced first with a form shown in FIGS. 1 to 4 which show first and second embodiments of the invention. In both embodiments a spiral member is capable of being rotated to scrape makeup liquid off the inner surface of the container body both during screwing and unscrewing of a cap onto and from the container body.

Figure 1:
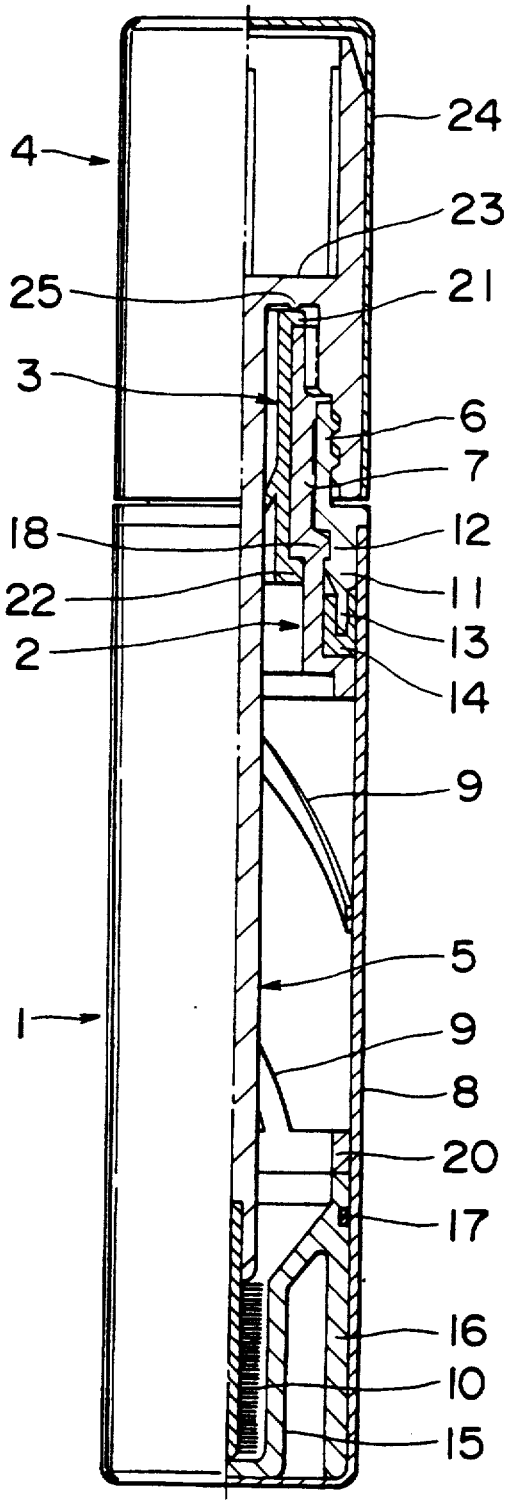
FIG. 1 is an elevational view of a first embodiment of the makeup liquid container with applicator in accordance with the present invention, with a half part thereof shown in section.
Figure 2:
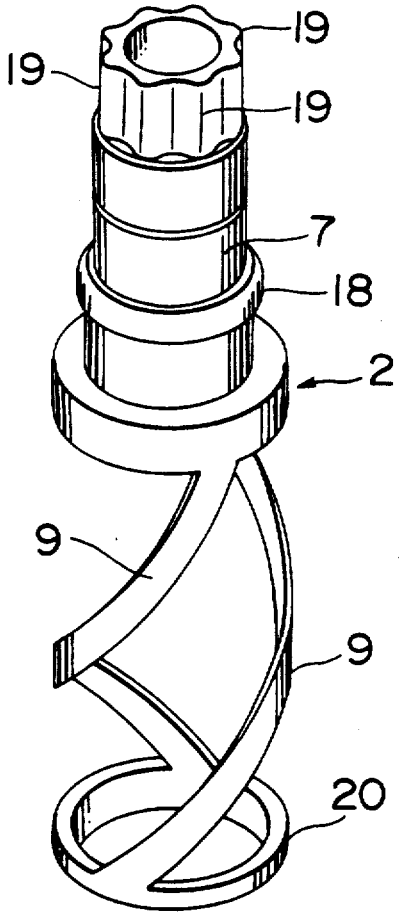
FIG. 2 is a perspective view of a rotatable member incorporated in the first embodiment.

Referring first to FIGS. 1 and 2, there is shown a makeup liquid container which includes an elongated container body 1 containing a makeup liquid and having an open neck portion 6 and a barrel portion 8, a rotatable member 2 having a rotatable cylinder 7 rotatably received in the open neck portion 6 such as to project upward from the open neck portion 6 and a spiral member 9 suspended from the lower end of the rotatable cylinder 7 while making a sliding contact with the inner surface of the barrel portion 8, a squeezing sleeve 3 fixed in the rotatable cylinder 7 of the rotatable member 2, a cap 4 splined to the outer surface of upper end portion of the rotatable cylinder 7 and held in screwing engagement with the outer surface of the open neck portion 6 of the container body 1 so as to be able to rotate the rotatable member 2 forwardly and backwardly when it is screwed onto and unscrewed from the open neck portion 6, an applicator shaft 5 extending downward into the container body 1 through the squeezing sleeve 3, and an applicator 10 such as a brush secured to the lower end of the applicator shaft 5.

In use, the user unscrews the cap 4 from the open neck portion 6 and pulls the same upward so that the applicator shaft 5 integral with the cap 4 and the applicator 10 fixed to the lower end of the applicator shaft 5 are extracted from the container body 1, through the squeezing sleeve 3. The squeezing sleeve 3 wipes makeup liquid off the outer surface of the applicator shaft 5 and squeezes the applicator 10 so as to optimize the amount of the makeup liquid held by the applicator 10.

During unscrewing of the cap 4, the rotatable member 2 splined to the cap 4 is rotatingly actuated so that the spiral member 9 of the rotatable member 2 rotates so as to scrape off any makeup liquid from the inner surface of the barrel portion of the container body 1. After the use, the user screws the cap 4 again onto the open neck portion 6 of the container body. The rotatable member 2 rotates also in this case so that the spiral member 9 performs scraping action in the reverse direction. Thus, the scraping action is performed upon each unscrewing and each screwing of the cap 4. The rotation of the spiral member 9, which performs the scraping function, also causes a stirring action to stir the makeup liquid in the container body thereby preventing undesirable solidification of the makeup liquid.

A first embodiment will be described in more detail hereinafter.

The first embodiment of the makeup liquid container with an applicator in accordance with the present invention has, as its major parts, a container body 1, a rotatable member 2 which has a spiral member 9 serving as a scraper member, a squeezing sleeve 3, a cap 4, and an applicator shaft 5.

The container body 1 is an elongated member made of a decorative metallic material, and has a straight cylindrical barrel portion 8 and a mouth member 11 fixed in an upper opening of the barrel portion 8 and provided with an open neck portion 6 of reduced diameter. The open neck portion 6 is externally threaded and is provided at an intermediate portion thereof with a groove 12 formed in the inner peripheral surface thereof. The lower end portion of the open neck portion 6 constitutes a mounting peripheral wall 13. An elastic ring member 14 having a portion of a substantially U-shaped sectional shape fits on the mounting peripheral wall 13 so as to cover the outer surface of the mounting peripheral wall 13. This elastic ring member 14 is a liquid-tight sealing member and serves also as a buffer member. A bottom member 15 having a funnel-like form with a bottom is fitted in the bottom of the container body 1 through a tubular portion 16. The bottom member 15 is intended to reduce the internal volume of the container body at the bottom portion thereof, so as to minimize the amount of the makeup liquid which finally remain in the container without being used. A reference numeral 17 designates a seal ring.

The rotatable member 2 has an upper rotatable cylinder 7 and a lower spiral member 9. The rotatable cylinder 7 is stepped such as to have a large-diameter lower portion, a medium-diameter intermediate portion and a small-diameter upper portion. The intermediate portion has an engaging ridge 18 protruding from the outer peripheral surface. The rotatable cylinder 7 rotatably fits in the mouth member 11 with its engaging ridge 18 received in the groove 12 mentioned before. A plurality of vertical engaging ridges 19 serving as spline teeth are formed on the upper end surface of the rotatable cylinder 7 projecting upward from the open neck portion 6. A pair of spiral members 9, 9 extend downwardly from diametrically opposing portions of the large-diameter lower end of the rotatable cylinder 7 in such a manner as to make sliding contact with the inner surface of the barrel portion 8 of the container body. A ring 20 is coupled to the lower ends of the spiral members 9, 9.

The squeezing sleeve 3 is made of a soft elastic material such as a rubber or a soft synthetic resin. An annular protrusion protrudes from the inner peripheral surface at a mid portion thereof so as to form a restricted opening. The squeezing sleeve 7 fits in the rotatable cylinder 7 by means of upper and lower outward flanges 21 and 22.

The cap 4 has a partition plate 23 at an intermediate portion thereof, so that it exhibits a substantially H-shaped sectional shape when taken along a vertical plane containing the axis thereof. The cap 4 is internally threaded at its lower end for engagement with the external thread on the open neck portion 6. Vertical engaging ridges serving as spline teeth and capable of engaging with the vertical engaging ridges 19 on the rotatable cylinder 7 are formed on the inner peripheral surface of the cap 4 at a portion immediately above the internal screw thread.

According to this arrangement, when the cap 4 is screwed onto and unscrewed from the open neck portion 6 of the container body 1, it causes the rotatable member 2 to rotate in one and the other directions through the spline engagement between itself and the rotatable cylinder 7 of the rotatable member 2. In consequence, the spiral members 9,9 integral with the rotatable member are made to rotate in one and the other directions along the inner peripheral surface of the barrel portion 8 so as to scrape makeup liquid therefrom. A reference numeral 24 designates a metallic outer member having a decorative effect fitted around the cap 4, while a numeral 25 designates a downward peripheral ridge which makes a pressure contact with the upper surface of the flange 21.

An applicator shaft 5 extends downward from the central portion of the partition plate 23 of the cap 4 into the bottom region of the container body 1, through the squeezing sleeve 3. The applicator shaft 5 is formed integrally with the cap 4. An applicator 10 such as a brush is fixed to the lower end portion of the applicator shaft 5 below the squeezing sleeve 3. The applicator 10 extends into the bottom member 15 which serves to reduce the internal volume at the bottom portion of the container body.

The parts described hereinabove without limitation of material, e.g., the rotatable cylinder and the spiral members 9,9, cap 4, applicator shaft 5, and the bottom member 15, may be formed by molding from a synthetic resin. The applicator 10 is typically a brush having bristles of a synthetic resin or animal hair.

As has been described, the first embodiment of the present invention employs rotatable member 2 having at least one spiral member 9 capable of sliding on the inner peripheral surface of the barrel portion 8 of the container body 1 is rotatably mounted in the mouth member 11 on the container body 1, in such a manner that the rotatable member 2 is rotated as the cap 4 is screwed onto and unscrewed from the container body. In consequence, the spiral member 9 performs scraping function upon each removal and each fitting of the cap 4, thus eliminating necessity for periodical scraping operation which is required by conventional makeup liquid container of this type. Since the scraping operation is executed automatically upon each fitting and removal of the cap, any risk for the user to forget the scraping operation is eliminated and the operation is facilitated. Since the removal and fitting of the cap is executed rather frequently due to frequent use of the applicator, the scraping of the makeup liquid is conducted before the makeup liquid attaching to the inner surface of the container body is hardened, thus ensuring a high scraping effect.

Figure 3:
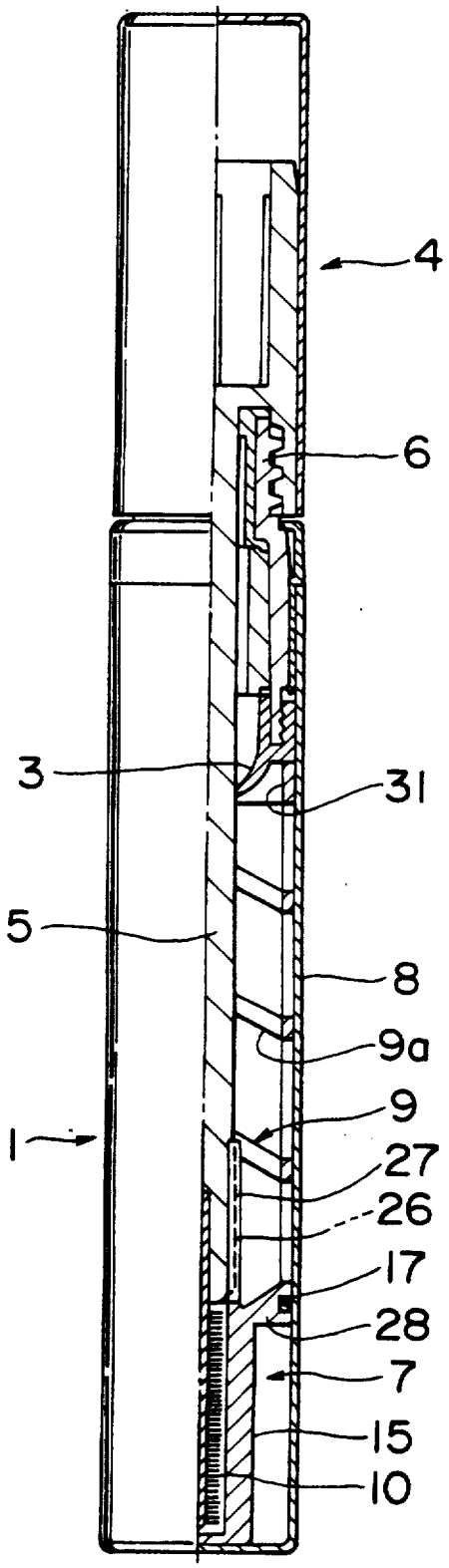
FIG. 3 is an elevational view of a second embodiment of the makeup liquid container with applicator in accordance with the present invention, with a half part thereof shown in section.
Figure 4:
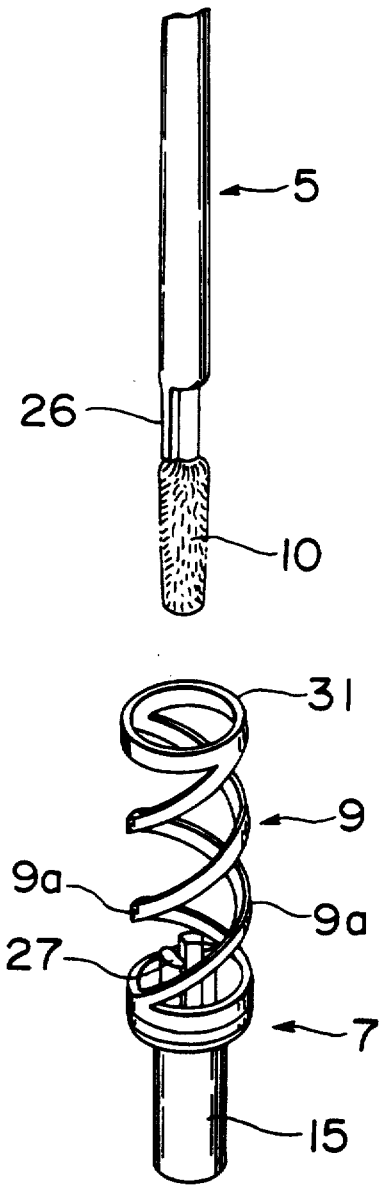
FIG. 4 is an exploded perspective view of a cylindrical member and an applicator used in the second embodiment.

FIGS. 3 and 4 show a second embodiment.

This embodiment comprises: a container body 1 having a barrel portion 8 and an open neck portion 6; a cap 4 screwed to the open neck portion 6; an applicator shaft 5 provided with an applicator 10 such as a brush fixed to the lower end thereof and extended from the cap 4 into the container body 1; a rotatable cylinder 7 fitted in the barrel portion 8, the applicator shaft 5 being provided at its lower outer portion with vertical engaging ridges 26 which is engageable with, when the cap is rotated, second vertical engaging ridges formed on the inner peripheral surface of the rotatable cylinder 7; and a spiral member 9 connected to the rotatable cylinder 7 and rotatable in sliding contact with the inner peripheral surface of the barrel portion 8.

Referring to FIG. 3, the cap is shown in a state screwed onto the container body with the first engaging ridges 26 on the applicator shaft 5 held in engagement with the second engaging ridges 27. When the cap 4 is unscrewed from the container body 1, the rotatable cylinder 7 and, hence, the spiral member 9 are rotated due to engagement between the first and second engaging ridges 26 and 27. The spiral member 9 is composed of a pair of spiral strings 9*a*, 9*b* the outer surfaces of which are held in sliding contact with the inner surface of the barrel portion 8 so as to scrape makeup liquid off the inner surface of the barrel portion 8. At the same time, the portion of the spiral member 9 immersed in the makeup liquid within the container body effectively stirs the makeup liquid as it is rotated. The same action is performed also during screwing of the cap onto the container body 1.

The second embodiment will be described in more detail. The second embodiment of the present invention has an elongated container body 1 with a barrel portion 8 and an open neck portion 6 standing upright therefrom. A squeezing sleeve 3 for optimizing the amount of the makeup liquid to be served by the applicator 10 is fixed in an upper portion of the container body 1.

A rotatable cylinder 7 for stirring the makeup liquid and for scraping makeup liquid off the container wall is rotatably fitted in the barrel portion 8 of the container body 1. The rotatable cylinder 7 has a small cylindrical portion 15 having an inside diameter slightly smaller than the outside diameter of a later-mentioned applicator shaft 10 and a plurality of bars serving as second engaging ridges 27 standing upright from the inner peripheral edge of the upper end of the small cylindrical portion 15 at a constant circumferential interval. A pair of spiral strings 9*a*, 9*a* are extended upright from outer peripheral edge of an outward flange 28 provided on the upper end of the small cylindrical portion 15. The upper ends of these spiral strings 9*a*, 9*a* are connected to the underside of a common ring so as to form a spiral member 9. The outward flange 28 contacts with the inner surface of the barrel portion 8 in a liquid-tight manner. In order to ensure the liquid tightness, an "O" ring 17 is fitted on the outer peripheral surface of the flange 28.

The spiral strings 9*a*, 9*a* are adapted to rotate in sliding contact with the inner surface of the barrel portion 8 of the container body 1 so as to scrape off any makeup liquid on the inner surface of the barrel portion 8. The ring 31 engages with the lower surface of the squeezing sleeve so as to prevent the cylindrical member 7 from moving up and down.

A cap 4 is capable of being closing open end of the open neck portion of the container body 1 by screwing engagement therewith. An applicator shaft 5 is suspended from the inner surface of the cap 4 downward into the container body 1. The applicator shaft 5 carries at its lower end an applicator 10 such as a brush which is received in the bore of the above-mentioned small cylindrical portion 15. First engaging ridges 26 for engagement with the aforementioned second engaging ridges 27 are formed on the outer surface of the applicator shaft 5 at a lower portion thereof. The axial length of mutually engaging portions of these engaging ridges 26,27 may be substantially the same as the axial length of the screwing engagement between the open neck portion 6 of the container body 1 and the cap 4.

In the second embodiment having the described construction, when the cap 4 is rotated in screwing or unscrewing direction with the applicator shaft 5 received in the container body 1, the spiral member 9 rotates in one and the other direction with respect to the container body 1 in sliding contact with the inner surface of the barrel portion 8 of the container body, whereby any matter attaching to the inner surface is scraped off by the spiral member 9. At the same time, the immersed portion of the spiral member effectively stirs the makeup liquid so as to maintain the makeup liquid in a state ready for use.

Third and fourth embodiments will be described with reference to FIGS. 5 to 8.

The third and fourth embodiments are common to the first and second embodiments in that the scraping of the makeup liquid off the container wall can be effected both during screwing and unscrewing of the cap, but are distinguished from the preceding embodiments in that they employ a stirrer which is different from the spiral members shown in FIGS. 1 to 4 and FIGS. 9 to 36 which will be mentioned later. It is to be noted, however, the spiral members shown in FIGS. 1 to 4 and FIGS. 9 to 36 fall within the concept of a stirrer. A scraper member shown in FIG. 6(*c*), which is twisted in a spiral form, also can be regarded as being a stirrer.

The third and the fourth embodiments have the following common features. Namely, the makeup liquid container has an elongated container body 1 containing a makeup liquid and having a barrel portion 8 and an open neck portion 6; a squeezing sleeve 3 fixedly mounted in the open neck portion 6; a stirrer 91 having a plurality of scraping members 93 and rotatably received in an intermediate portion of the container body 1; a cap 4 screwed to the outer surface of the open neck portion 6; an applicator shaft 10 extending downward from the cap 4 into the container body 1 through the squeezing sleeve 3 and the stirrer 9, the applicator shaft 5 being splined at its intermediate portion to the stirrer 91 so as to rotate the stirrer 91 in one and the other directions when the cap 4 is rotated in screwing and unscrewing directions; and an applicator such as a brush fixed to the lower end of the applicator shaft 5.

In use, the user unscrews the cap 4 from the open neck portion 6 and extracts the applicator shaft 5 integral with the cap 4. During the extraction, the applicator shaft 5 and the applicator 10 are made to pass through the squeezing sleeve 3 so that the squeezing sleeve 3 wipes makeup liquid off the surface of the applicator shaft 5 and squeezes the applicator 8 so as to optimize the amount of the makeup liquid to be served by the applicator 8.

The applicator shaft 5 and the stirrer 91 are splined to each other so that they are relatively movable in the axial direction but not in the rotational direction. Since the cap 4 rotates during unscrewing, the applicator shaft 5 is rotated during removal of the cap, with the result that the stirrer 91 also rotates to stir the makeup liquid in the container body 1, thereby preventing the solidification and deposition of the makeup liquid. At the same time, by positioning the stirrer in the close proximity of the inner surface of the container body 1, the solid content of the makeup liquid depositing to the wall surface of the container body 1 is scraped and dissolved again in the liquid. Since the lower portion of the container body 1 is restricted to such an extent as to just receive the applicator 10, it is possible to minimize the makeup liquid which remains in the container body without being used.

Figure 5:
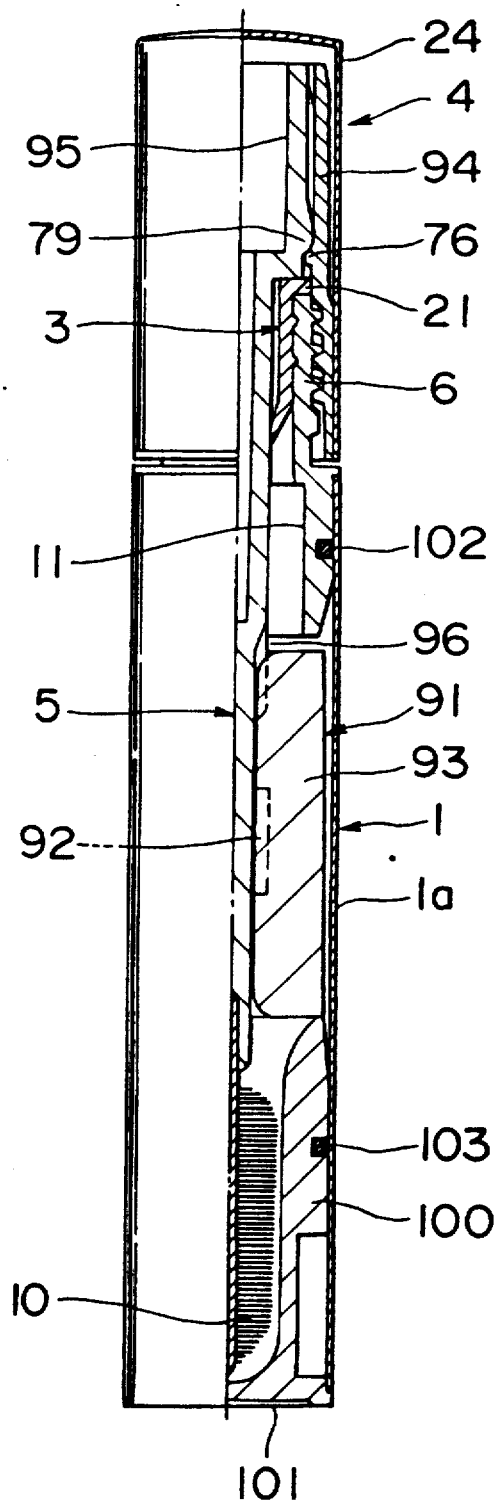
FIG. 5 is an elevational view of a third embodiment of the makeup liquid container with applicator in accordance with the present invention, with a half part thereof shown in section.
Figure 6A:
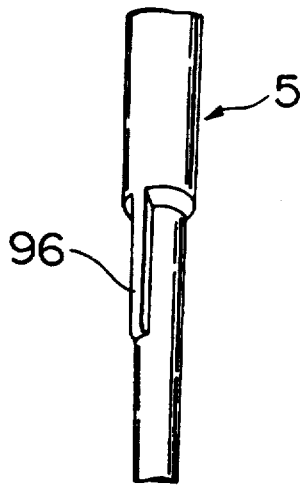
FIG. 6(*a*) is a perspective view of an essential portion of an applicator shaft used in the third embodiment.
Figure 6B:
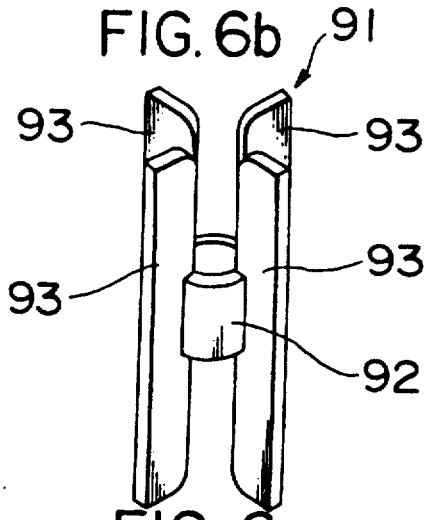
Figure 6C:
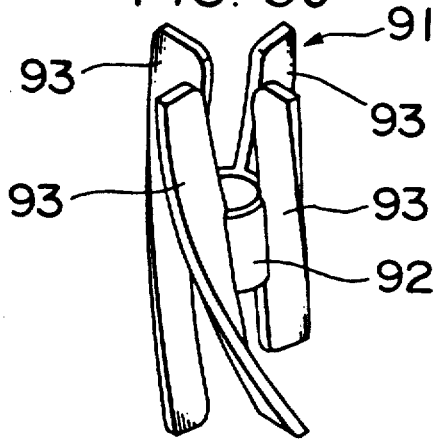

The third embodiment will be described with specific reference to FIGS. 5 and 6.

The container body 1 has a barrel portion 8 made of a metallic material having decorative effect and a mouth portion 11 fitted in the upper end opening of the barrel portion 8 and having an open neck portion 6 of a reduced diameter. The lower end opening of the barrel portion 8 is covered by a bottom member 100 fitted therein and a decorative metallic cover plate 10 is secured to the underside of the bottom member 100. The bottom member 100 has a considerably large thickness so that it occupies the space inside the container body 1 at the bottom thereof such that the applicator 10 is just received.

The squeezing sleeve 3 is made of a soft elastic material such as a rubber or a soft synthetic resin. The squeezing sleeve 3 is provided with an outwardly extending flange 21 which is adapted to reset on the top of the open neck portion 6. The lower end of the squeezing sleeve 3 is so restricted as to make a resilient pressure contact with the applicator shaft 5. In this state, the squeezing sleeve 3 is fitted and fixed by friction in the open neck portion 6.

The stirrer 91 has a short cylindrical member 92 having a bore of a size large enough to allow the applicator shaft 5 to pass therethrough, and four scraping blades 94 extending radially outwardly from the outer surface 92 of the short cylinder at a 90° interval. The stirrer 91 is rotatably disposed in an intermediate portion of the container body 1 between the mouth member 11 and the bottom member 100. Preferably, the stirrer 91 is arranged such that the scraping blades 93 are held in the close proximity of the inner surface of the container body 1. The scraping blades 93 may have linear or straight form or twisted form as shown in FIGS. 6(*b*) and 6(*c*).

The cap 4 has a cylindrical member 94 the lower half part of which is internally threaded with a decorative metallic cap cover member 24 fitted on the outer surface of the cylindrical member 94.

The applicator shaft 5 has a cylindrical upper portion 95 of a large diameter which fits in the upper half portion of the cap 4 and is fixed thereto by mutual engagement between the engaging ridges 76 and 79. The portion of the applicator shaft 5 immediately under the large-diameter cylindrical portion 95 corresponding to the squeezing sleeve 3 has a cylindrical form with a reduced diameter and the lower portion of this reduced-diameter cylindrical portion is shaped as a rod. An applicator 10 such as a brush is secured to the lower end of the rod. Wedge-shaped engaging tabs 96 are provided the outer surface of the upper end of the rod, for engagement with the scraping blades 93.

Figure 7:
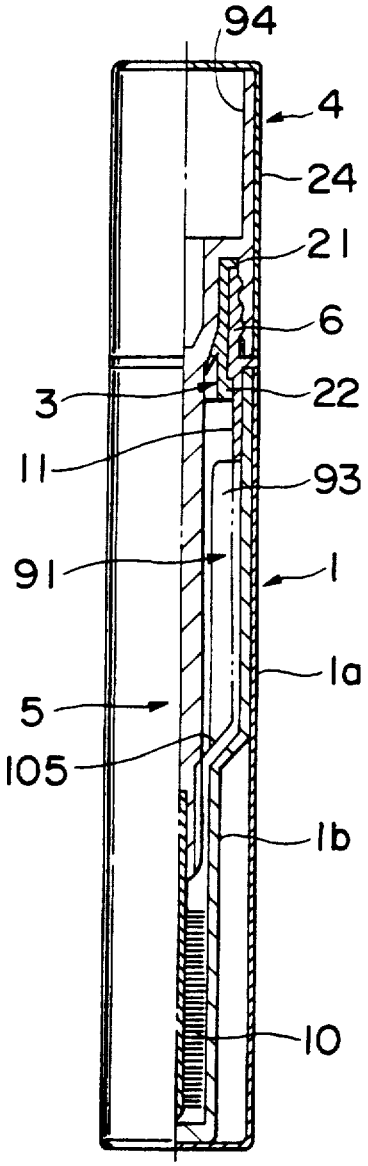
FIG. 7 is an elevational view of a fourth embodiment of the makeup liquid container with applicator in accordance with the present invention, with a half part thereof shown in section.
Figure 8:
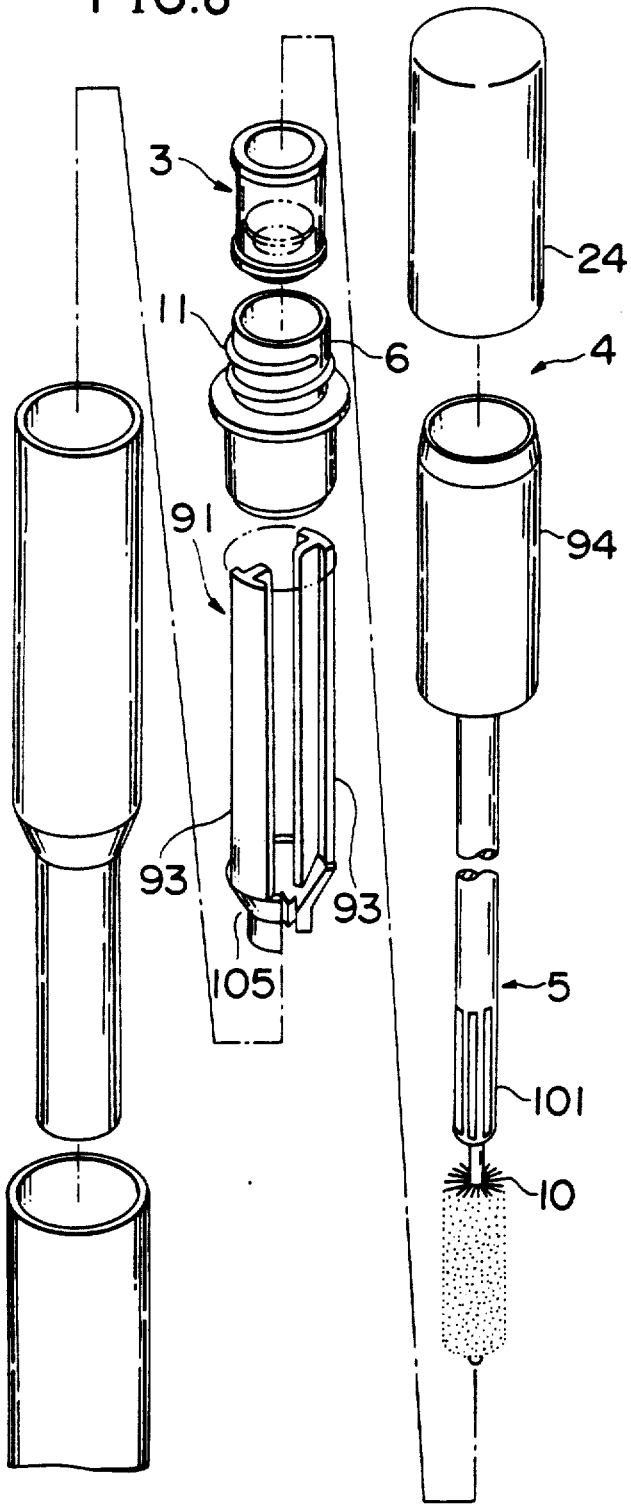
FIG. 8 is an exploded perspective view of the fourth embodiment.

The fourth embodiment will now be described with specific reference to FIGS. 7 and 8.

In this embodiment, the container body 1 has a double-wall structure composed of a decorative metallic outer member 1*a* and an inner member 1*b* fitted in the outer member 1*a*. The inner member 1*b* has a lower half portion which is contracted to reduce its inside diameter as to just receive the applicator 10. The squeezing sleeve 3 has an inner peripheral ridge projecting radially inwardly at an axially intermediate portion thereof, so as to form a restricted opening. The squeezing sleeve 3 also has an engaging ridge 22 provided on the outer surface of the lower end of the cylindrical portion and an outward flange 21 which engage with steps on the inner surface of the open neck portion 6. The stirrer 91 has a substantially frusto-conical member 105 and scraping blades 93, 93 protruded from both sides of the upper surface of the frusto-conical member 105. A multiplicity of vertical grooves are formed in the inner peripheral surface of the small-diameter opening of the cylindrical member 105, while the applicator shaft 5 is provided with a multiplicity of vertical grooves for spline engagement with the cylindrical member 105. The applicator shaft has a cylindrical upper end portion at which it is integrated with the cap 4. As in the case of the third embodiment, the scraping blades 93, 93 may be straight or twisted.

It will be clear that this embodiment provides the same effects as those offered by the third embodiment.

Components other that those specifically mentioned as being made from a metal can be molded from a synthetic resin.

As has been described, in the third and the fourth embodiments, a stirrer 91 is rotatably mounted in a container body 1 such as to be spline-engaged with an applicator shaft 5 which is suspended from a cap 4 screwed onto the open neck 6 of the container body 1. Therefore, when the cap is rotated in the screwing or unscrewing direction to enable the user to insert or extract the applicator shaft 5 into and out of the container body, the stirrer 91 which makes spline-engagement with the applicator shaft 5 is rotated so as to perform scraping and stirring actions. According to this arrangement, since the rotation of the stirrer 91 is caused by rotation of the cap 4 which is necessarily effected before and after the use of the applicator, it is not necessary to effect scraping operation separately. Since the scraping and stirring effects are produced without fail each time the cap is unscrewed for removal, the density of the makeup liquid to be served is always optimized.

Fifth to twelfth embodiments will be described hereinafter with reference to FIGS. 9 to 27. These embodiments have common features in that they employ a spiral member 9 as the stirrer and in that a ratchet mechanism 32 is provided in the path of transmission of the rotation between the cap 4 and the spiral member 9 so that the rotation of the spiral member 9 is caused only in such a direction as to scrape the makeup liquid downward. The path of transmission of rotation may be such that a rotatable cylinder 7 which may either be integral or in engagement with the spiral member 9 is rotated by the cap 4 directly or indirectly through the applicator shaft 5. When the rotatable cylinder 7 is rotated by the cap 4 directly, the ratchet mechanism 32 is provided between the cap 4 and the rotatable cylinder 7 or between the rotatable cylinder 7 and the spiral member 9. When the rotation transmission path includes the applicator shaft 5, the ratchet mechanism 32 is provided between the applicator shaft 5 rotatable as a unit with the cap 4 and the rotatable cylinder 7 or between the rotatable cylinder 7 and the spiral member 9.

Fifth and sixth embodiments will be described first with reference to FIGS. 9 to 12.

The makeup liquid container of this embodiment has an elongated container body 1 containing a makeup liquid, a spiral member 9 rotatably mounted in the container body such as to make a sliding contact with the inner surface of the barrel portion 8 of the container body 1 and provided at upper end thereof with a ring 31, a rotatable cylinder 7 having a lower end connected to the ring 31 through the ratchet mechanism 32, a squeezing sleeve 3 fixed in said rotatable cylinder 7, a cap 4 which is splined to the upper outer surface of the rotatable cylinder 7 and screwed to the outer surface of the open neck portion 6 of the container body, the cap 4, when unscrewed, being capable of rotating the spiral member 9 through the rotatable cylinder 7, and an applicator shaft 5 extending downward into the container body 1 through the squeezing sleeve 3, and an applicator 10 such as a brush attached to the lower end of the applicator shaft 5.

For the purpose of application of the makeup liquid, the user unscrews the cap 4 off the open neck portion 6 and moves it upward so as to extract the applicator shaft 5 integral with the cap 4. During the extraction of the cap 4, the applicator shaft 5 and the applicator 10 are forcibly made to pass through the squeezing sleeve 3 so as to wipe makeup liquid off the surface of the applicator shaft and to squeeze the applicator 10 thereby to optimize the amount of the makeup liquid held by the applicator 10.

During the removal of the cap 4, the rotatable cylinder 7 splined to the cap 4 or the applicator shaft 5 is rotated and the rotation of the rotatable cylinder 7 is transmitted to the spiral member 9 through the ratchet mechanism 32 so that the spiral member frictionally slides on the inner surface of the barrel portion of the container body 1 thereby scraping makeup liquid off the inner surface of the barrel portion. At the same time, the portion of the spiral member 9 immersed in the makeup liquid in the container body 1 effectively stirs the makeup liquid, thus preventing solidification of the makeup liquid.

Figure 9:
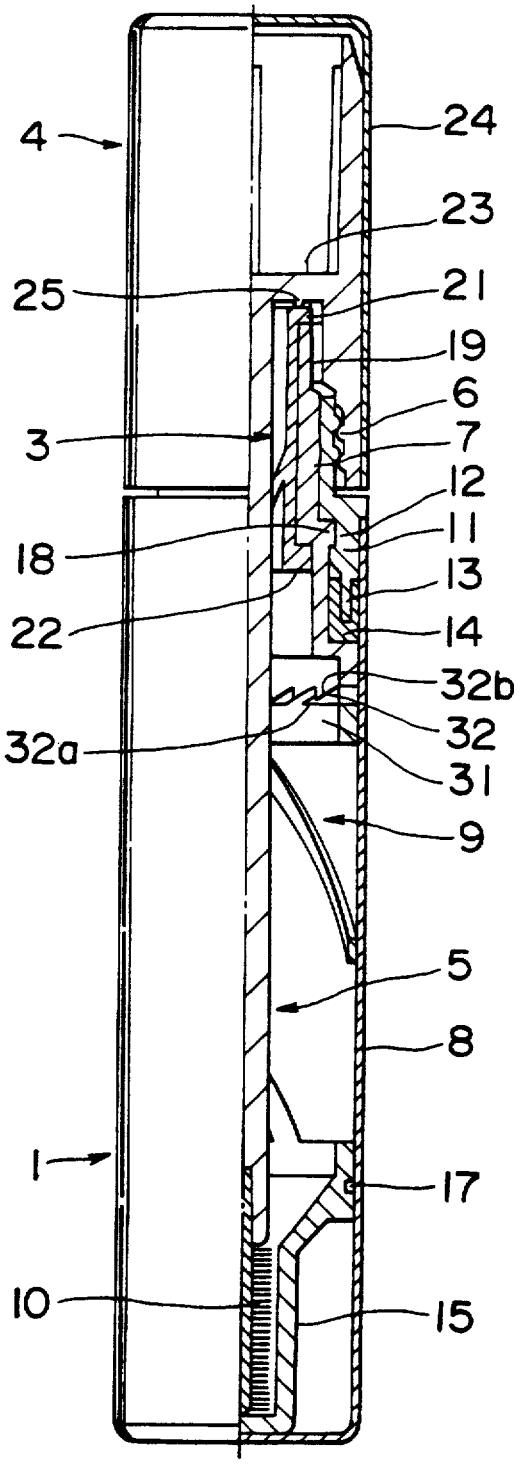
FIG. 9 is an elevational view of a fifth embodiment of the makeup liquid container with applicator in accordance with the present invention, with a half part thereof shown in section.
Figure 10:
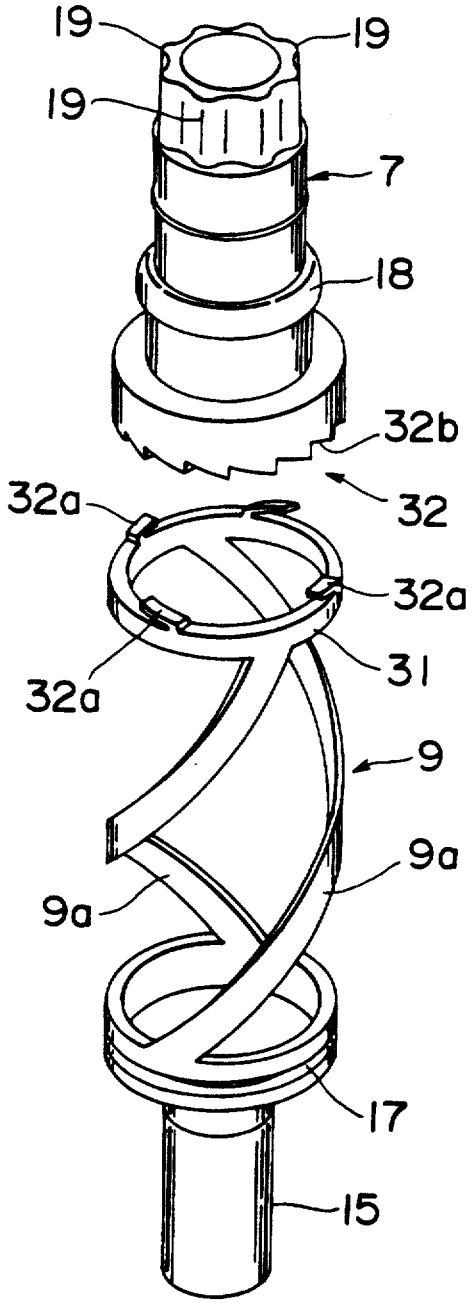
FIG. 10 is an exploded perspective view illustrating a spiral member and a rotatable cylinder incorporated in the fifth embodiment.

The fifth embodiment will be described in detail with specific reference to FIGS. 9 to 10. The fifth embodiment of the makeup liquid container with applicator has, as its major components, a container body 1, a spiral member 9 which serves as stirrer and scraper, a squeezing sleeve 3, a cap 4 and an applicator shaft 5.

The container body 1 is an elongated member which is made of a decorative metallic material, and has a mouth member 11 fixedly fitted in the upper end opening thereof. The mouth member 11 has an open neck portion 6 of a reduced diameter. The open neck portion 6 has an external screw thread and is provided on the inner peripheral surface thereof with a groove 12 formed at an axially intermediate portion thereof The lower end portion of the open neck portion constitutes a mounting peripheral wall 13 and an elastic ring member 14 having a portion of a substantially U-shaped sectional shape is attached to the open neck portion 6 in such a manner as to cover the outer surface of a mounting peripheral wall 13. This elastic ring member 14 constitutes a liquid-tight seal member and serves also as a buffer member.

The spiral member 9 includes a pair of spiral strings 9*a*,9*a* which stand upright from diametrically opposing portions of the upper end of a bottom-equipped funnel-like bottom member 15 and a ring 31 connected to the upper ends of these spiral strings 9*a*, 9*a*. This spiral member 9 is rotatably mounted in the container body 1 in sliding contact with the inner surface of the container body 1. The spiral strings 9*a*, 9*a* are so shaped that they can scrape makeup liquid on the inner surface of the container body downward. The bottom member 15 has an upper enlarged portion with a groove formed therein, and a seal ring 17 is fitted in the groove so as to provide a liquid-tight seal between the bottom member 15 and the inner surface of the container body 15. The bottom member 15 serves to reduce the volume of the space inside the container body 1 at the bottom portion of the container body 1, so that all part of the makeup liquid is used without remaining wastefully. A ratchet mechanism 32 has four engaging claws 32*a* provided on four portions of the upper surface of the ring 31 and bent in one direction.

The rotatable cylinder 7 has a stepped form composed of a lower portion of a large diameter, an intermediate portion of a medium diameter and an upper portion of a small diameter. An engaging ridge 18 is formed on the surface of the intermediate portion. The rotatable cylinder 7 is rotatably mounted in the mouth member 11 with the engaging ridge held in engagement with the groove 12. A plurality of vertical engaging ridges 19 are formed on the portion of the rotatable cylinder 7 projecting above the open neck portion 6 at a predetermined circumferential pitch. Ratchet teeth 32*b* having a saw-teeth form are formed on the outer periphery of the lower end of the large-diameter lower portion of the rotatable cylinder 7 for engagement with the engaging claws 32*a*. The ratchet mechanism 32 is designed to transmit torque from the cap 4 to the rotatable cylinder 7 only when the cap 4 is rotated in the unscrewing direction. Namely, torque is not transmitted when the cap 4 is rotated in the screwing direction.

The squeezing sleeve 3 is made of a soft elastic material such as a rubber or a soft synthetic resin and is provided on the inner peripheral surface thereof with a restricted opening at an axially mid portion thereof, and is fitted in an upper portion of the rotatable member 7 by means of outward flanges 21, 22.

The cap 4 is a substantially cylindrical member which is provided at its intermediate portion with a partition plate 23 so as to exhibits a substantially H-shaped cross-section. The cap 4 is internally threaded at its lower portion for engagement with the open neck portion 6 and is provided with vertical grooves immediately above the internal thread for engagement with the vertical ridges 19. Therefore, rotation of the cap 4 in the screwing or unscrewing direction causes the rotatable cylinder 7 in one or the other direction. However, in this embodiment, the ratchet mechanism 32 transmits the torque only when the cap 4 is rotated in the unscrewing direction. A reference numeral 24 denotes a decorative metallic outer member which fits around the cap 4, while a numeral 25 denotes a downward sealing flange which is pressed onto the flange 21.

The applicator shaft 15 is formed integrally with the cap 4 and extends downward from the center of the partition plate 23 down into the container body 1 through the squeezing sleeve 3. An applicator 10 such as a brush is fixed to the lower end of the squeezing sleeve 3. The applicator 10 is received in the restricted bottom member 15.

Figure 11:
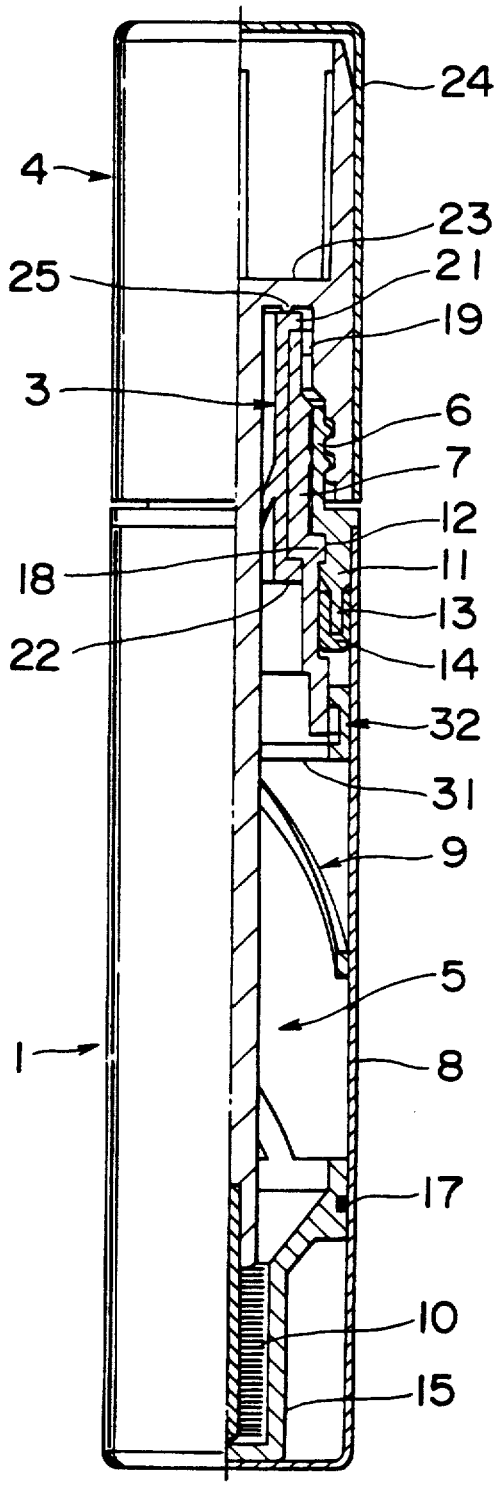
FIG. 11 is an elevational view of a sixth embodiment of the makeup liquid container with applicator in accordance with the present invention, with a half part thereof shown in section.
Figure 12:
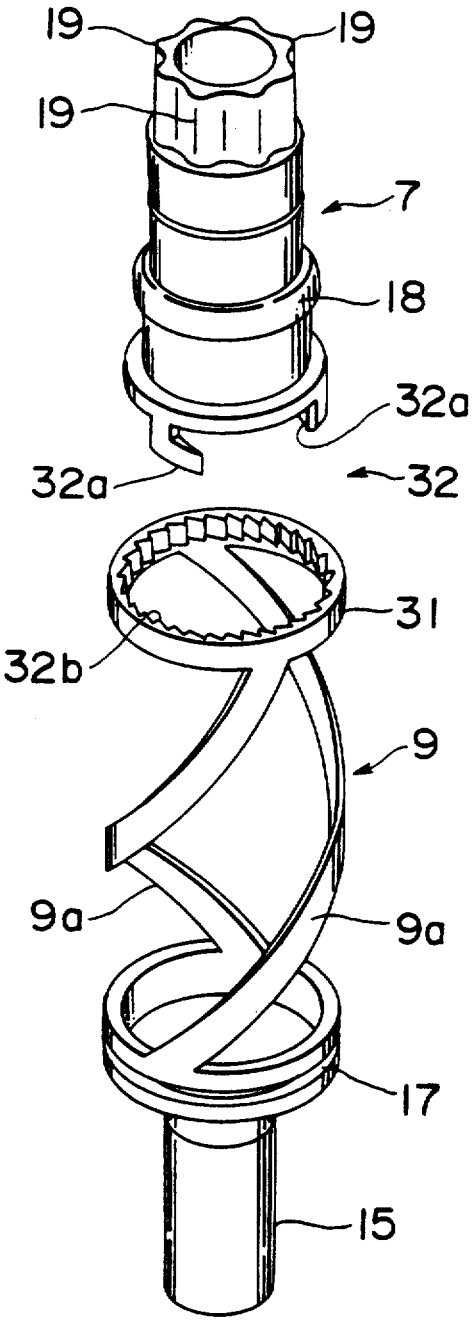
FIG. 12 is an exploded perspective view illustrating a spiral member and a rotatable cylinder incorporated in the sixth embodiment.

FIGS. 11 and 12 show a sixth embodiment of the present invention. In this embodiment, the saw-teeth-like ratchet teeth 32*b* and the engaging claws 32*a* of the fifth embodiment are replaced with each other. Namely, the teeth 32b are formed on the inner peripheral surface of the ring 31, while the engaging claws 32a are formed to suspend from the lower end of the rotatable cylinder 7. It will be clear that the sixth embodiment operates in the same manner as that of the fifth embodiment.

In the fifth and sixth embodiments as described, a rotatable cylinder 7 is provided in the open neck portion of the container body 1 so as to be rotated by the cap 4 when the cap 4 is rotated in the screwing and unscrewing directions, while a spiral member 9 capable of sliding on the inner surface of the barrel portion of the container body 1 is disposed in the container body 1. The rotation of the rotatable cylinder 7 is transmitted to the spiral member 9 only when the cap 4 is rotated in the unscrewing direction so that the scraping action is performed only when the cap 4 is rotated in the unscrewing direction for removal. In consequence, the removal of the cap 4 and the scraping of the solidified makeup liquid can be completed in one action, so that the operation is facilitated and the scraping can be conducted without being forgotten. In addition, the solidified component of the makeup liquid, scraped off the inner surface of the barrel portion of the container body 1, is dissolved again in the liquid whereby reduction in the effective amount of the liquid, as well as thinning of the same, is avoided.

Seventh and eighth embodiment will be described with reference to FIGS. 13 to 16. Each of the seventh and eighth embodiments has an elongated container body 1 containing a makeup liquid, a squeezing sleeve 3 fixed in the upper part of the barrel portion 8 of the container body 1, a spiral member 9 provided at its upper or lower part with a ring-shaped member 41 for sliding contact with the inner surface of the container body 1, a cap 4 screwed to the outer surface of the neck portion 6 of the container body 1, an applicator shaft 5 extending downward from the cap 4 into the container body 1 through the squeezing sleeve 3, an applicator 10 such as a brush secured to the lower end of the applicator shaft 5, and a rotatable cylinder 7 which is splined to the outer surface of the applicator shaft 5 and cooperate with the ring-shaped member 41 to form a ratchet mechanism which transmits the rotation of the applicator shaft 5 to the spiral member 9 when the cap 4 is rotated in the unscrewing direction.

In use, the user unscrews and lifts the cap 4 off the open neck portion 6 of the container body 1 so as to extract the applicator shaft 5 integral with the cap 4. During the extraction, the applicator shaft 5 and the applicator 10 are forcibly made to pass through the squeezing sleeve 3 so that the squeezing sleeve 3 wipes makeup liquid off the surface of the applicator shaft 5 and squeezes the applicator 10 so as to optimize the amount of the makeup liquid held by the applicator. Since the applicator shaft 5 is splined to the rotatable cylinder 7 so as to be movable in the vertical direction relative to the rotatable cylinder, the rotatable cylinder 7 remains unmoved though the applicator shaft 5 is extracted.

During the unscrewing of the cap 4, the applicator shaft 5 rotates together with the cap 4 so that the rotatable cylinder 7 splined to the applicator shaft 5 is rotated. The rotation of the rotatable cylinder 7 is transmitted through the ratchet mechanism 32 to the spiral member 9 so that the spiral member 9 rotates in contact with the inner surface of the barrel portion 8 of the container body 1 so as to scrape the makeup liquid off the inner surface. During the rotation, the spiral member also stirs the liquid in the container body so as to effectively prevent solidification of the makeup liquid.

Figure 13:
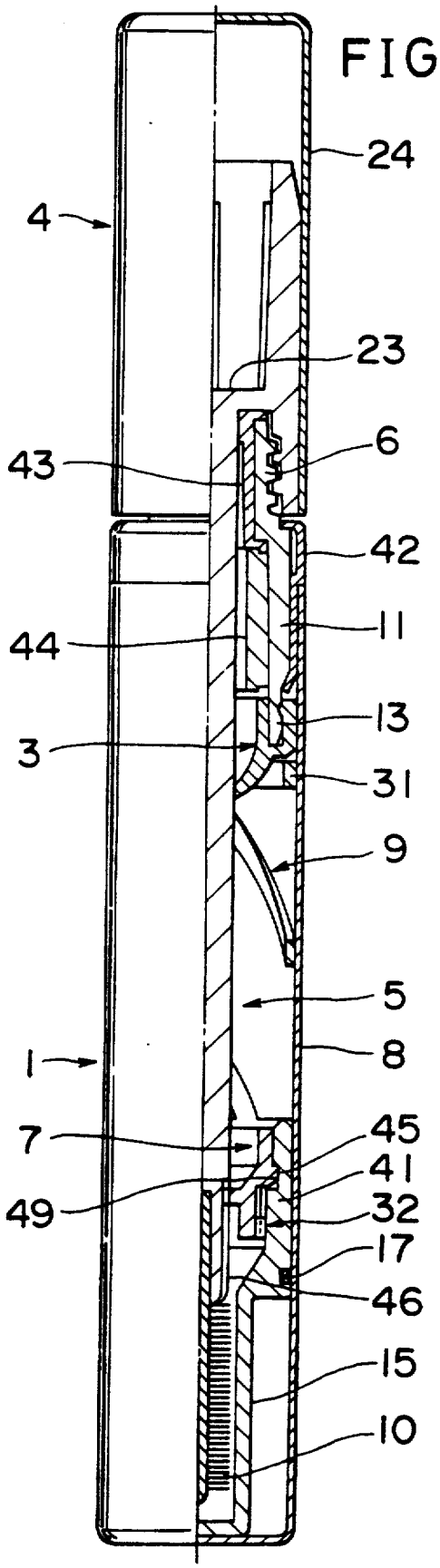
FIG. 13 is an elevational view of a seventh embodiment of the makeup liquid container with applicator in accordance with the present invention, with a half part thereof shown in section.
Figure 14:
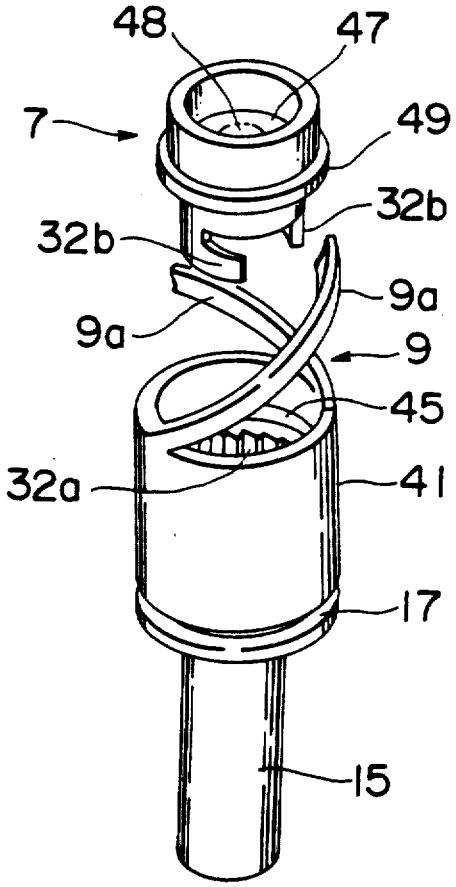
FIG. 14 is an exploded perspective view illustrating a spiral member and a rotatable cylinder incorporated in the seventh embodiment.
Figure 17:
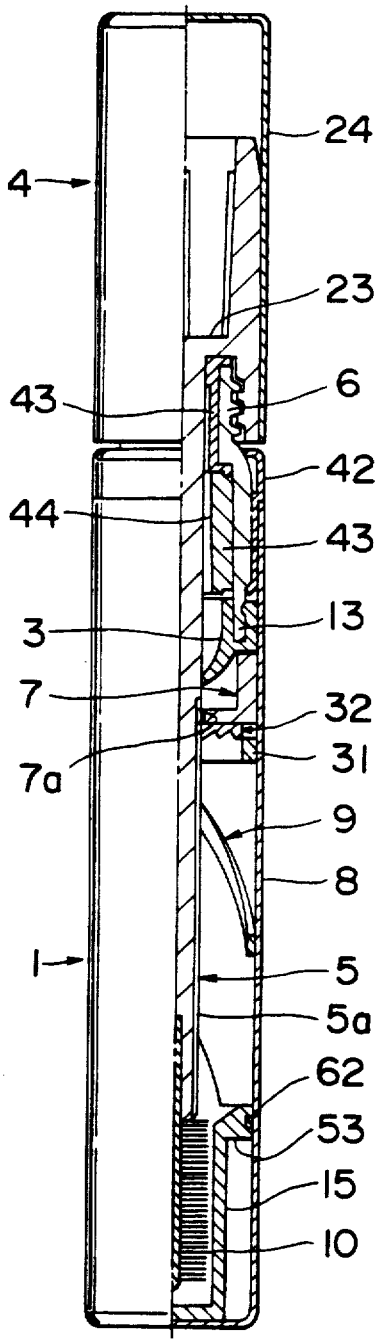
FIG. 17 is an elevational view of a ninth embodiment of the makeup liquid container with applicator in accordance with the present invention, with a half part thereof shown in section.
Figure 18:
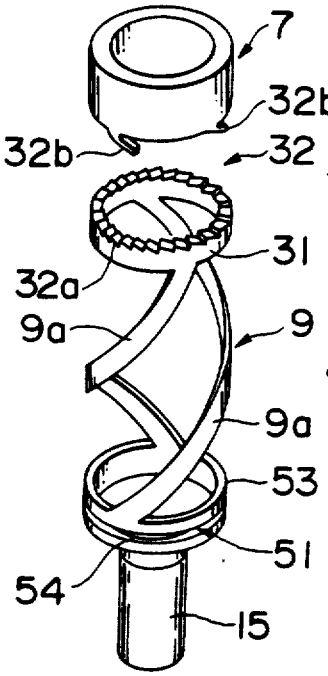
FIG. 18 is an exploded perspective view illustrating a spiral member and a rotatable cylinder incorporated in the ninth embodiment.

The seventh embodiment of the present invention will be described with reference to FIGS. 13 to 15. The makeup liquid container of this embodiment has, as its major components, a container body 1, a squeezing sleeve 3, a spiral member 9 serving as a scraping member, an applicator shaft 5 and a rotatable cylinder 7.

The container body 1 is an elongated member made from a decorative metallic member having a straight cylindrical barrel portion 8 and a mouth member 11 fixed in the upper end opening of the barrel portion 8 by means of a fixing member 42, the mouth member 11 having an open neck portion 6 with a reduced diameter. The open neck portion 6 is externally threaded and the lower end portion thereof is thin-walled so as to form a mounting peripheral wall 13. A seal member made of a soft elastic material such as a rubber or a soft synthetic resin is fitted in the open neck portion 6 by means of outwardly extending flanges formed on the upper and lower ends thereof. The seal member 43 is retained by a retainer sleeve 44 made of a rigid member such as a metal which is fixed in the lower part of the open neck portion 6 immediately under the seal member 43.

The squeezing sleeve 3 is made of a soft elastic material such as a rubber or a soft synthetic resin and has a restricted opening formed in the lower end thereof. The squeezing sleeve 3 has a mounting portion of a substantially U-shaped sectional shape. The squeezing sleeve is fixed in an upper portion of the barrel portion 8 with its mounting portion firmly engaging with the mounting peripheral wall 13. The squeezing sleeve 3 also provides sealing and buffer effect. The spiral member 9 has a ring member 41 from which a bottom restricting member is suspended integrally and a pair of spiral strings 9a, 9a which stands upright from diametrically opposing portions of the ring member 41 so as to make a sliding contact with the inner surface of the barrel portion 8. This spiral member 9 is rotatably received in the container body 1. The spiral strings 9a, 9b are so shaped as to be able to scrape the makeup liquid off the surface of the container body 1 downward. The ring member 41 is provided with an engaging groove 45 formed in the inner peripheral surface thereof and a plurality of saw-teeth-shaped ratchet teeth 32a immediately under the engaging groove 45. The bottom member 15 provides a restricted bottom of the container body 1 so as to minimize the quantity of the makeup liquid which remains in the container body 1 without being used. A reference numeral 17 denotes a seal ring, while a numeral 31 denotes a ring which is integrally connected to the upper ends of the spiral strings 9a, 9a. The cap 4 is a substantially cylindrical member having a partition plate 23 formed at an intermediate portion thereof such as to have a substantially H-shaped cross-section, and is internally threaded at its lower portion so as to engage with the external thread of the open neck portion. An outer member 24 made of a decorative metallic member is fitted around the cylindrical body of the cap 4.

The applicator shaft 5 is formed integrally with the cap 4 and extends downwardly from the center of the partition plate 23 into the container body 1 through the seal member 43 and the squeezing sleeve 3. A brush or a similar applicator 10 is fixed to the lower end of the applicator shaft 5. The applicator 10 is received in the bore of the bottom member 15. As will be seen from FIG. 15(*a*), a vertical engaging ridge 46 is formed on the outer peripheral surface of the applicator shaft 5.

The rotatable cylinder 7 has a lower half portion of a reduced diameter and is provided with a partition plate 24 provided at an intermediate portion thereof. The partition plate 24 has a bore through which an applicator shaft 5 is extended and an engaging notch or recess 48 engagable with the engaging ridge 46 on the applicator shaft 5 is provided in the partition plate 24 as shown in FIG. 15(*a*). The rotatable cylinder 7 is disposed between the applicator shaft 5 and the ring member 41 with its engaging ridge 49 engaging with the groove 45 so as not to come off. A pair of ratchet claws 32*b*, 32*b* of the ratchet mechanism 32 are provided on the diametrically opposing portions of the lower end of the rotatable cylinder 7. The ratchet mechanism 32 is designed to transmit torque only when the cap 4 is rotated in the unscrewing direction. When the cap 4 is rotated in the screwing direction, the rotation of the cap 4 is not transmitted to the spiral member 9. Thus, when the cap 4 is rotated in the unscrewing direction so as to be removed from the container body 1, the rotation of the cap 4 is transmitted to the applicator shaft 5 and further to the rotatable cylinder 7 the rotation of which is transmitted to the spiral member 9 whereby the spiral member 9 rotates along the inner wall surface of the barrel portion 8 of the container body 1, thus enabling the spiral member 9 to scrape the inner surface of the container body 8.

The arrangement for attaining engagement between the applicator shaft 5 and the rotatable cylinder 7 shown in FIG. 15(*a*) is only illustrative. Any construction which enables the rotatable cylinder 5 to rotate as a unit with the applicator shaft 5 while allowing the latter to move vertically relative to the rotatable cylinder 7 may be used in place of the arrangement of FIG. 15 (*a*). For instance, arrangements as shown in FIGS. 15(*b*), 15(*c*) and 15(*d*) can be used equally well. The arrangement shown in FIG. 15(*b*) employs a ridge 46 which engages with an engaging notch 48 of the type shown in FIG. 15(*a*).

The components such as the spiral member 3, cap 4, applicator shaft 5 and the rotatable cylinder 7, the materials of which are not specifically mentioned, may e molded from a synthetic resin. The applicator 10 may be formed from a synthetic resin. The applicator 10, when it is a brush, may have bristles of a synthetic resin or anumal hair.

FIG. 16 shows the eighth embodiment of the present invention in which the ring 41 and, hence, the rotatable cylinder 7 are disposed on the upper end of the spiral member 9, and the engaging ridge 46 of the applicator shaft 5 is correspondingly extended upward. The operation and effect of the eigth embodiment are materially the same as those of the seventh embodiment.

As has been described, in the seventh and eighth embodiment of the present invention, a rotatable cylinder 7 is engaged with an applicator shaft 5 which is rotatable in one and the other direction as the cap 4 is rotated in screwing and unscrewing directions, and a spiral member 3 capable of sliding on the inner surface of the barrel portion 8 is provided and connected to the rotatable cylinder 7 such that the rotation of the rotatable cylinder 7 is transmitted to the spiral member 9 only when the cap 4 is rotated in the unscrewing direction. Therefore, unscrewing the cap 4 to remove it from the container body 1 for the purpose of application of the makeup liquid, the spiral member 9 automatically scrapes makeup liquid from the inner surface of the barrel portion 8. In consequence, the scraping is effected without fail each time the cap 4 is removed, so that the scraping operation is facilitated and is conducted without being forgotten. The solidified content of the makeup liquid scraped off the inner surface of the container body 1 is dissolved again in the makeup liquid in the bottom of the container, thus preventing any decrease of the effective amount of the makeup liquid and undesirable thinning of the same.

A description will be given hereinafter of ninth to eleventh embodiments with reference to FIGS. 17 to 22.

These embodiments have the following common features. Namely, the makeup liquid container of these embodiments have an elongated container body 1 containing a makeup liquid, a squeezing sleeve 3 fixed in the upper opening of a barrel portion 8 of the container body 1, a cap 4 screwed to an open neck portion 6 of the container body 1, an applicator shaft 5 extended downwardly from the cap 4 into the container body 1 through the squeezing sleeve 3, a brush or a similar applicator 10 fixed to the lower end of the applicator shaft 5, a spiral member 9 provided with a ring member 41 on the upper end thereof and disposed in the container body 1 in contact with the inner surface of the barrel portion 8 of the container body such that a certain frictional force is developed between the inner surface of the barrel portion 8 and the spiral member 9 or a suitable mechanism for preventing rotation of the spiral member 9 due to dragging in a ratchet mechanism is provided therebetween so that the spiral member 9 is rotated when the cap 4 is rotated in the unscrewing direction but not rotated when the same is rotated in the screwing direction, and a rotatable cylinder 7 which is splined to the outer surface of the applicator shaft 5 and cooperating with the annular member 41 so as to constitute a ratchet mechanism 32 which enables the rotation of the applicator shaft 5 caused by the rotation of the cap 4 to be transmitted to the spiral member 9 only when the cap 4 is rotated in the unscrewing direction.

In use of the makeup liquid, the user unscrews the cap 4 and lifts it up together with the applicator shaft 5 so as to extract the applicator shaft 5. During the extraction, the applicator shaft 5 and the applicator 10 are forcibly made to pass through the squeezing sleeve 3 so that the squeezing sleeve wipes makeup liquid off the outer surface of the applicator shaft 5 and squeezes the applicator 6 so as to optimize the amount of the makeup liquid to be served by the applicator. Since the rotatable cylinder 7 and the applicator shaft 5 are splined to each other, the rotatable cylinder 7 is never lifted though the applicator shaft 5 is withdrawn from the container body 1.

During the unscrewing of the cap 4, the applicator shaft 5 rotates as a unit with the cap 4 so that the rotatable cylinder 7 splined to the applicator shaft 5 is rotated. The rotation of the rotatable cylinder 7 is transmitted to the spiral member 9 through the ratchet mechanism 32 so that the spiral member 9 is rotated to scrape any component of the makeup liquid depositing on the inner surface of the barrel portion 8 of the container body 1. At the same time, the portion of the spiral member 9 immersed in the makeup liquid in the container body 1 effectively stirs the makeup liquid, thus preventing solidification and deposition of the makeup liquid. When the cap 4 is rotated in the screwing direction, the ratchet mechanism 32 does not transmit rotation. In addition, the mechanism 51 for preventing the dragging in the ratchet mechanism 32 is provided between the spiral member 9 and the barrel member 8, so that the spiral member 9 is never rotated. The ninth embodiment will be described with reference to FIGS. 17 and 18. The makeup liquid container in accordance with the present invention has, as its major parts, a container body 1, a squeezing sleeve 3, a cap 4, an applicator shaft 5, a spiral member 5 as a scraping member, and a rotatable cylinder 7. The construction of the container body 1, liquid squeezing cylinder 3 and the cap 4 are the same as those of the seventh embodiment so that the same reference numerals are used as those in the seventh embodiment and detailed description thereof is omitted.

The applicator shaft 5 is formed integrally with the cap 4 and is extended from the center of the partition plate 23 thereof down into the container body 1 through the seal member 43 and the squeezing sleeve 3. At the same time, an applicator 10 such as a brush is secured to the lower end of the applicator shaft 1. The lower half part of the applicator shaft 5 extending below the squeezing sleeve 3 has a polygonal cross-section such as, for example, a square cross-section. The spiral member 9 has a pair of spiral strings 9*a*, 9*a* extending upright from the diametrically opposing portions of an outward flange 53 on the upper end of a frusto-conical bottom member 15, in such a manner as to make contact with the inner surface of the barrel portion 8 of the container body 1. The spiral member 9 further has a ring member 31 to which the upper ends of the spiral members 9*a* and 9*a* are connected. The spiral member 9 is rotatably received in the container body 1. The spiral strings 9*a*, 9*a* are so shaped as to be able to scrape makeup liquid downward off the inner surface of the container body 1. Saw-teeth-shaped ratchet teeth 32*a* are formed on the upper side of the ring 31. The bottom member 15 serves to reduce the volume at the lower end of the container body 1 so as to leave only a space for just receiving the applicator 10, whereby the amount of the makeup liquid which remains without being used is minimized.

A reference numeral 54 denotes a sealing "O" ring which is received in a groove formed in the outer peripheral surface of a flange 53 which extends outward from the bottom member 15. The "O" ring makes a frictional contact with the inner surface of the barrel portion 8 so as to provide an optimum friction between the barrel portion 8 and the spiral member 9, thus serving as a rotation resistance means for preventing unintentional rotation of the spiral member 9 due to a drag in the ratchet mechanism 32.

The rotatable cylinder 7 is a cup-shaped member with a polygonal hole, e.g., a square hole 7*a*, formed in the bottom wall thereof. This hole 7*a* fits around the polygonally-sectioned portion of the applicator shaft 5 so that the applicator shaft 5 and the rotatable cylinder 7 are so engaged with each other that they can move relatively to each other in the axial direction but relative rotation therebetween is not allowed. A plurality of ratchet claws 32*b* are formed at the lower end of the rotatable cylinder 7 in such a manner as to project downward from the peripheral portion thereof. The ratchet mechanism 32 can transmit the torque only when the cap 4 is rotated in the unscrewing direction. Namely, the ratchet mechanism 32 does not transmit torque when the cap 4 is rotated in the screwing direction. Thus, when the cap 4 is being rotated in the screwing direction, the spiral member 9 is kept stationary without rotating even when a slight force is transmitted through the ratchet mechanism due to dragging, thanks to the effect of the "O" ring 54 which serves as the rotation resistance mechanism. When the cap 4 is unscrewed to be removed, the rotation of the applicator shaft 5 is transmitted from the rotatable cylinder 7 to the spiral member 9 through the ratchet mechanism 32 against the resistance caused by the rotation resistance mechanism 51, whereby the spiral member 9 scrapes makeup liquid off the inner surface of the barrel portion 8 of the container body 1.

Figure 19:
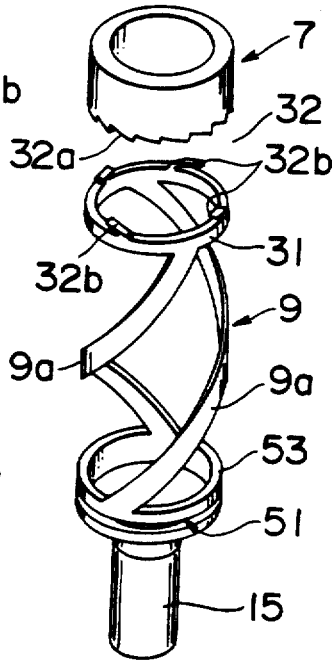
FIG. 19 is an exploded perspective view illustrating a spiral member and a rotatable cylinder incorporated in the tenth embodiment.

The effect of the rotation resistance mechanism is as follows. If the "O" ring 54 serving as the rotation resistance mechanism is omitted, the spiral member 9 tends to be rotated even during rotation of the cap 4 in the screwing direction, due to a phenomenon generally known as dragging which takes place in the ratchet mechanism. In consequence, the spiral member 9 is rotated in the counter direction tending to scrape and move the makeup liquid upward along the inner surface of the barrel portion 8. The scraped makeup liquid, therefore, is liable to deposite again onto the inner surface of the barrel portion 8 particularly when the makeup liquid container is held horizontally or when only a small quantity of liquid is remaining in the container. The engagement between the applicator shaft 5 and the rotatable sleeve 7, which is attained by the polygonal cross-section of the applicator shaft 5*a* and the hole 7*a* of the corresponding form formed in the rotational sleeve 7, is only illustrative and various other forms are possible provided that it permits the applicator shaft 5 to move upward relative to the cylindrical member 7 while preventing any relative rotation therebetween. FIG. 19 shows the tenth embodiment is which the relationship between the saw-teeth-like ratchet teeth 32*a* and the ratchet claws 32*b* of the ratchet mechanism 32 is reversed from that of the ninth embodiment: namely, the teeth 32*a* are provided on the rotatable sleeve 7 while the ratchet claws 32*b* are provided on the ring 31.

Figure 20:
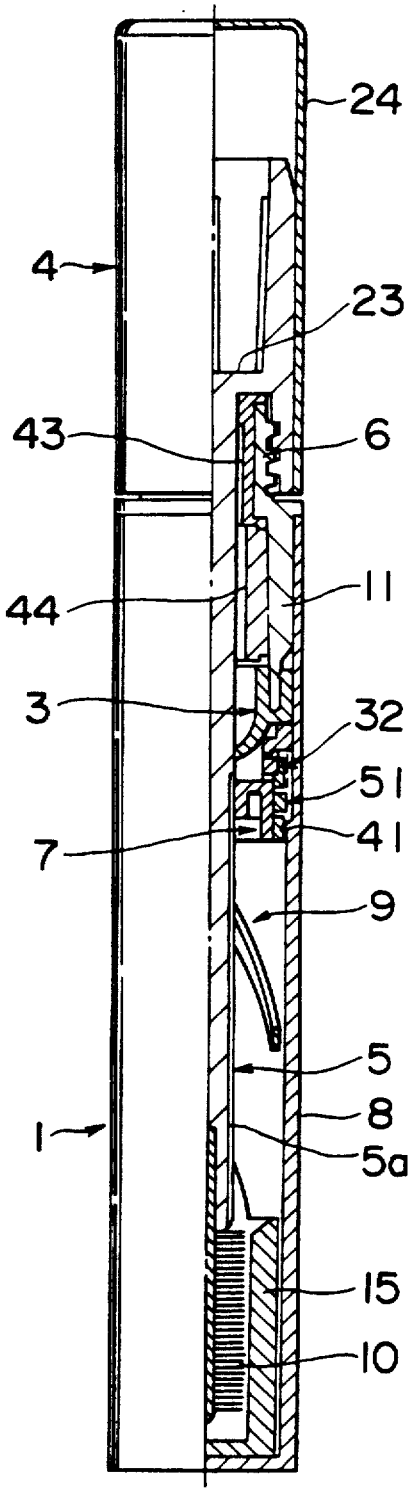
FIG. 20 is an elevational view of an eleventh embodiment of the makeup liquid container with applicator in accordance with the present invention, with a half part thereof shown in section.
Figure 21:
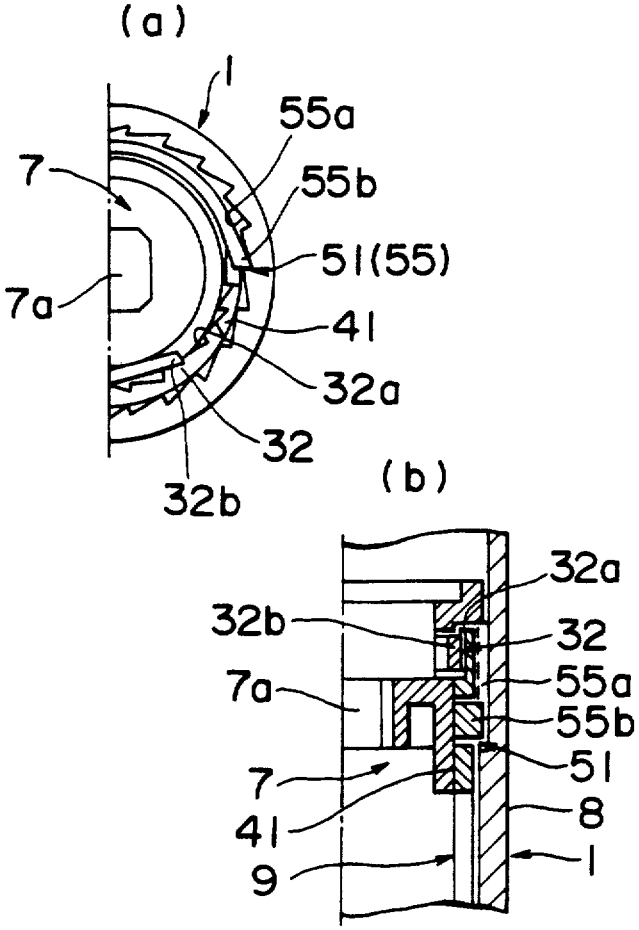
FIGS. 21(*a*) and 21(*b*) are a plan view and a vertical sectional view of a half portion of the eleventh embodiment, illustrating a ratchet mechanism and a rotation prevention means incorporated in the eleventh embodiment.
Figure 22:
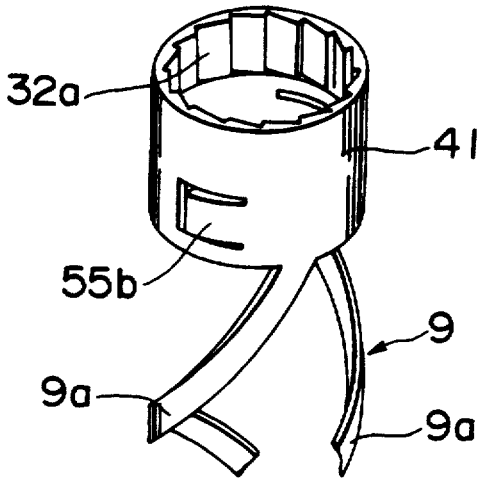
FIG. 22 is a perspective view of a spiral member incorporated in the eleventh embodiment.
Figure 23:
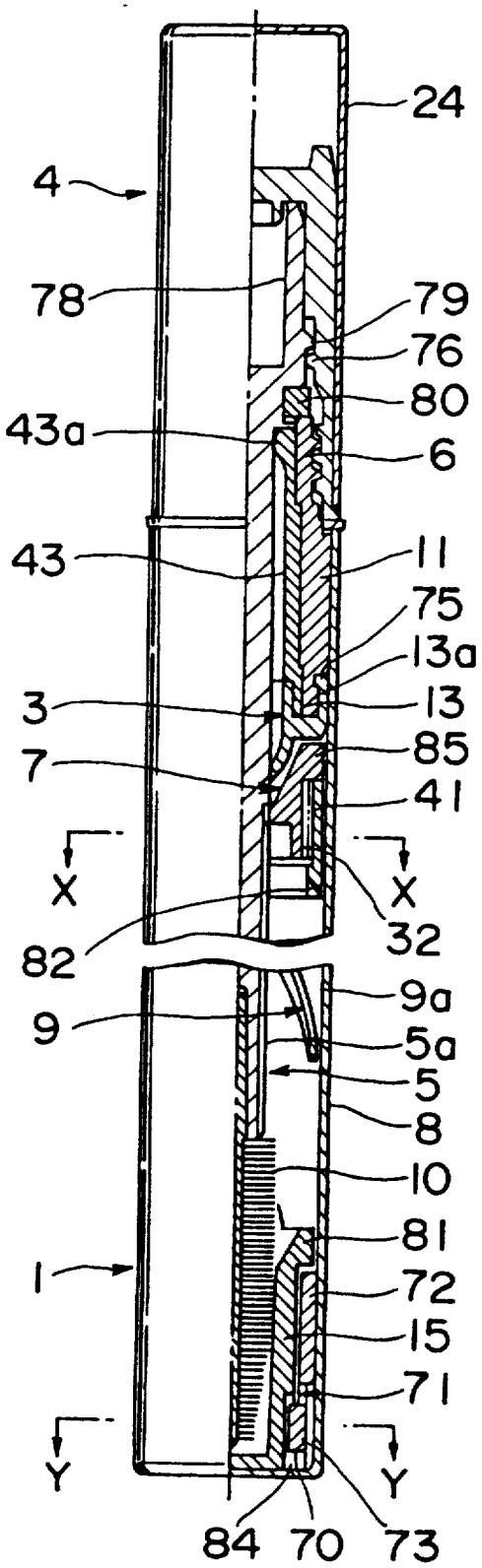
FIG. 23 is an elevational view of a twelfth embodiment of the makeup liquid container with applicator in accordance with the present invention, with a half part thereof shown in section.
Figure 24A:
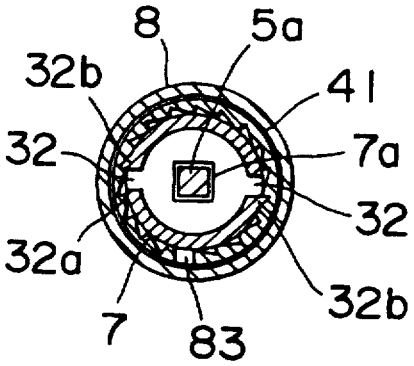
FIGS. 24(*a*) and 24(*b*) are cross-sectional views taken along the lines X—X and Y—Y of FIG. 23.
Figure 24B:
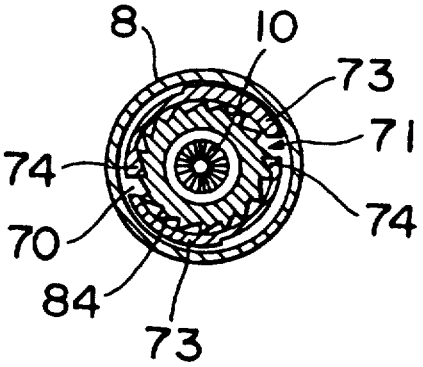
Figure 25A:
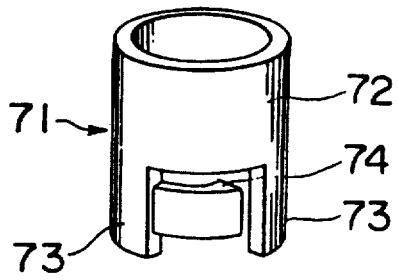
FIGS. 25(*a*) to 25(*d*), 26(*a*) to 26(*d*) and 27(*a*) to 27(*d*), respectively, are illustrations of a fixing ring with a claw, spiral member and a rotatable member incorporated in the twelfth embodiment, showing these parts in perspective view, top plan view, partly-sectioned elevational view and bottom plan view, respectively.
Figure 25B:
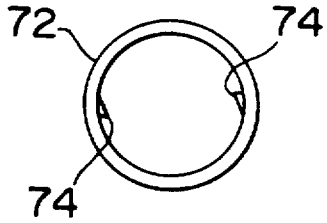
Figure 25C:
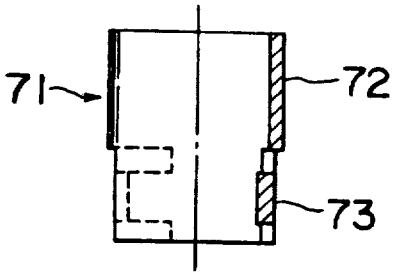
Figure 25D:
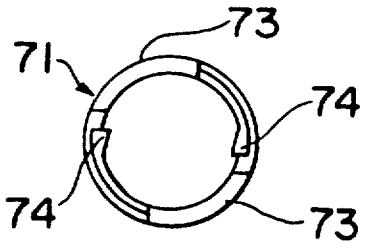
Figure 26B:
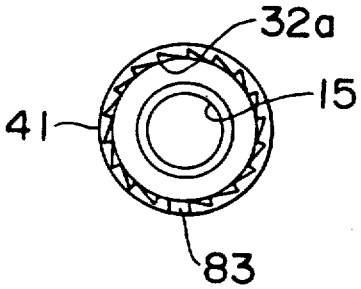
Figure 26A:
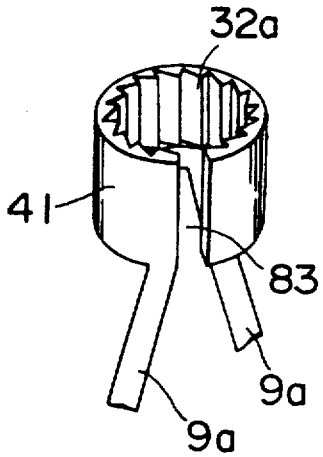
Figure 26C:
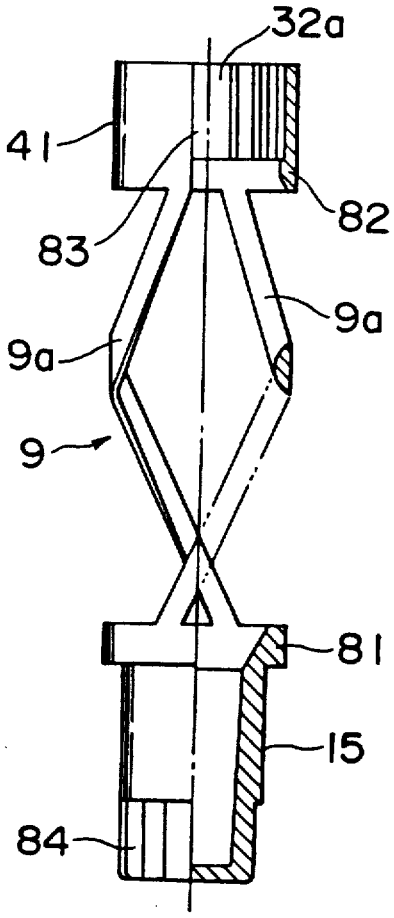
Figure 26D:
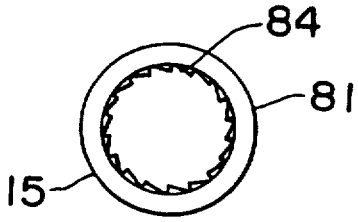

FIGS. 20 to 22 illustrate the eleventh embodiment which employs, as a the rotation resistance means, a second ratchet mechanism which transmits power in the direction reverse to that in the first ratchet mechanism. More specifically, the second ratchet mechanism 55, which transmits the torque in the direction reverse to that in the first ratchet mechanism 32, is provided between the outer surface of the spiral member 9 and the inner surface of the barrel portion 8 such that the second ratchet mechanism 55 provides an engagement between the inner surface of the barrel portion 8 and the spiral member 9 when the cap 4 is rotated in the screwing direction. Therefore, when the cap 4 is rotated in the unscrewing direction, the torque of the cap 4 is transmitted to the spiral member 9 through the ratchet mechanism 32 so that the spiral member 9 rotates to perform scraping action because in this case the second ratchet mechanism 55 allows the spiral member 9 to rotate. On the other hand, when the cap is rotated in the screwing direction, the second ratchet mechanism 55 operates to anchor the spiral member 9 on the inner surface of the barrel portion 8, thereby preventing any scraping effect from being produced.

The first ratchet mechanism 32 has teeth 32*a* formed on the inner surface of the upper end of the ring 41 which in this case has a large vertical length, and cooperating a ratchet claw 32*b* which is projected radially outward from a portion of the peripheral wall of the rotatable cylinder 7 which is received in the ring 41. On the other hand, the second ratchet mechanism 55 has a saw-teeth-like ratchet teeth 55*a* formed on the inner peripheral surface of the upper end of the barrel portion 8 and an engaging claw 55*b* projected radially from the outer peripheral portion of the ring 41 at a lower portion of the ring 31 corresponding to the teeth 55*a*. The container body 1 is molded from a synthetic resin.

According to this arrangement, it is possible to prevent rotation of the spiral member 9 without fail when the cap is rotated in the screwing direction, so that the undesirable upward movement of the scraped makeup liquid along the inner surface of the container body 1 can be prevented advantageously.

As has been described, the tenth and eleventh embodiments have a rotatable cylinder 7 which is splined to the applicator shaft 5 capable of rotating in one and the other directions during screwing and unscrewing of the cap 4 and a spiral member 9 capable of rotating in sliding contact with the inner surface of the barrel portion 8 of the container body 1, the spiral member being drivingly connected to the rotatable cylinder 7 through a ratchet mechanism such that the rotation of the rotatable cylinder 7 is transmitted to the spiral member 9 only when the cap 4 is rotated in the unscrewing direction. Therefore, scraping action on the inner surface of the barrel portion 8 of the container body 1 is performed each time the user unscrews the cap 4 to remove it and extract the applicator to apply the makeup liquid. Thus, the scraping is effected simultaneously with the removal of the cap 4 so that it can be conducted without being forgotten. The spiral member 9 is prevented from rotating when the cap 4 is being rotated in the screwing direction. In consequence, the makeup liquid is always scraped in the downward direction so as to be dissolved in the makeup liquid in the container, thus preventing reduction in the effective amount of the makeup liquid and undesirable thinning of the makeup liquid.

A twelfth embodiment of the present invention will be described with reference to FIGS. 23 to 27.

This embodiment has an elongated container body 1 containing a makeup liquid, a squeezing sleeve 3 fitted in the upper portion of the barrel portion 8 of the container body 1, a cap 4 screwed to the open neck portion 6 of the container body 1, an applicator shaft 5 extending downward from the cap 4 into the container body 1 through the squeezing sleeve 3, an applicator 16 such as a brush attached to the lower end of the applicator shaft, a spiral member 9 which is provided at its upper end with a ring member 41 having inner peripheral saw-teeth 32*a* and at its lower end with a cup-shaped restricted portion 15, the spiral member 9 being rotatably received in the container body 1 in sliding contact with the inner wall surface of the barrel portion 8 and being adapted to rotate when the cap 4 is rotated in the unscrewing direction but not to rotate when the cap 4 is rotated in the screwing direction, and a rotatable cylinder 7 splined to the outer surface of the applicator shaft 5 and having a claw 32*b* which engages with the saw-teeth 32*a* so as to form, in cooperation with the ring member 41, a ratchet mechanism 32 which transmits the rotation of the applicator shaft 5 to the spiral member 9 only when the cap 4 is being rotated in the unscrewing direction. In addition, a second ratchet mechanism 70, which transmits torque in the direction counter to the direction of torque transmission performed by the first ratchet mechanism, is provided between the container body 1 and the rotatable sleeve 7 or the spiral member 9. In use of the makeup liquid, the user unscrews the cap 4 from the open neck portion 6 so as to extract the applicator shaft 5 integral with the cap 4. During the extraction, the applicator shaft 5 and the applicator 10 are made to pass through the squeezing sleeve 3 so that the squeezing sleeve 3 wipes any makeup liquid off the outer surface of the applicator shaft 5 and squeezes the applicator 10 so as to optimize the amount of the makeup liquid held by the applicator 10. Since the rotatable cylinder 7 and the applicator shaft 5 are splined to each other such that these two members are vertically freed from each other while being prevented from rotating relative to each other, the rotatable member 7 is not rotated when the applicator shaft 5 is extracted.

During the unscrewing of the cap 4, the applicator shaft 5 integral with the cap 4 rotates to cause a rotation of the rotatable cylinder 7 splined to the applicator shaft 5. The rotation of the rotatable cylinder 7 is transmitted through the ratchet mechanism 32 to the spiral member 9 so as to effect scraping of makeup liquid component off the inner surface of the barrel portion 8 of the container body 1, whereby the scraped makeup liquid component is dissolved again in the makeup liquid in the makeup liquid container thereby preventing reduction in the effective amount of the makeup liquid and undesirable thinning of the same. In addition, the rotation of the spiral member 9 effectively stirs the makeup liquid in the container body so as to prevent solidification of the makeup liquid in the container body. Conversely, when the cap 4 is rotated in the screwing direction, the spiral member 9 is drivingly disconnected from the cap 4 so as to be stationed without being rotated. This is ensured by the second ratchet mechanism 70. The twelfth embodiment will be described in more detail. The makeup liquid container in accordance with the twelfth embodiment has, as its major parts, a container body 1, a squeezing sleeve 3, a cap 4, an applicator shaft 5, a spiral member 9 serving as a scraper member, and a rotatable cylinder 7 as a rotatable member.

The container body 1 has an elongated straight cylindrical barrel portion 8 made of a decorative metallic material and a mouth member 11 fitted in the upper end opening of the barrel portion 8 and having an open neck portion 6 of a reduced diameter. The mouth member 11 is externally threaded at the upper portion thereof constituting the open neck portion 6, while the lower end portion thereof is thin-walled so as to provide a mounting peripheral wall 13. An engaging ridge 13*a* is formed on the outer surface of the peripheral wall 13. The mouth member 11 fittingly receives a seal member 43 made of a soft elastic material such as a rubber or a soft synthetic resin and having a ridge 43*a* in the inner peripheral surface at the upper end portion thereof. A stationary ring 72 having a claw is fixed in a lower portion of the barrel member 8. The claw constitutes a part of a lower ratchet mechanism 70 which prevents the spiral member 9 from rotating when the cap 4 is rotated in the screwing direction. The stationary ring 71 has an upper ring 72 fitted in the barrel portion 8 of the container body 1 and legs 73,73 suspending from diametrically opposing portions of the lower edge of the upper ring 72 and claws 74,74 projected from the ends of the legs 73,73 in the circumferential direction.

The squeezing sleeve 3 is made of a soft elastic material such as a rubber or a soft synthetic resinous material and is provided with a restricted opening at the lower end thereof. The squeezing sleeve 3 has a mounting portion having a substantially U-shaped sectional shape. The squeezing sleeve 3 is fitted in an upper part of the barrel portion 8 with the U-sectioned mounting portion fitted on the portions where the mounting peripheral wall 13 and the lower portion of the seal member 43 are superposed on each other. An engaging ridge 75 on the squeezing sleeve 3 engages with an engaging ridge 13 on the peripheral wall 13 so as to prevent the squeezing sleeve 3 from coming off.

The cap 4 is provided with a screw thread formed in the inner peripheral surface at a lower portion thereof for engagement with the external screw thread of the open neck portion 6. An engaging ridge 76 is formed on the inner peripheral surface of the cap 4 at an intermediate portion thereof. An outer member made of a decorative metallic material is provided on the outer surface of the cap 4.

The applicator shaft 5 has an upper cylindrical portion 78 which fits in the cap 4, whereby the applicator shaft 5 is integrated with the cap 4. A brush or a similar applicator 10 is fixed to the lower end of the shaft below the seal member 43 and the squeezing sleeve 3. An engaging ridge 79 engaging with the engaging ridge 76 mentioned above is formed on the outer surface of the cylindrical portion 78. An "O" ring 80 providing a liquid-tight seal is provided on the bottom of the cylindrical member 78. The lower half part of the applicator shaft 5 below the squeezing sleeve 3 has a polygonal cross-section such as a square shape.

The spiral member 9 has a cup-shaped bottom member 15 provided at its upper end with an outward flange 81, and a pair of spiral strings 9*a*,9*a* protruding upright from diametrically opposing portions of the flange 81 such as to make contact with the inner surface of the barrel portion 8, with a ring member 41 connected to the upper ends of the spiral strings 9*a* 9*a*. The spiral member 9 is rotatably disposed in the barrel portion 8 of the container body 1 with its flange 81 held in a substantially close contact with the barrel portion 8. The spiral strings 9*a*, 9*a* are so shaped that they can scrape solidified makeup liquid component off the inner surface of the barrel portion 8 towards the bottom of the container body 1 when the cap 4 is rotated in the unscrewing direction.

The ring member 41 is provided with saw-teeth-shaped ratchet teeth 32*a* of a ratchet mechanism 32 formed on the inner peripheral surface thereof. An engaging ridge 82 is provided on the inner peripheral surface of the ring member 41 at the lower end thereof. The engaging ridge 82 is partly cut-out as at 83 so as to facilitate parting from a mold, thus simplifying the process for manufacturing the container.

The bottom member 15 is situated on the bottom of the container body 1 and has a bore which is sized to just receive the applicator 10 so that the amount of the makeup liquid which remains in the liquid container without being used is minimized. Saw-teeth 84 are formed on the outer peripheral surface of the bottom member 15 at a lower portion thereof. The saw-teeth 84 cooperate with the aforementioned claws 74,74 in forming a lower ratchet mechanism 70. The second ratchet mechanism 70 is designed such that it transmits torque so as to fix the spiral member 9 against rotation when the cap 4 is rotated in the screwing direction, but does not transmit torque so as not to impede the scraping action of the spiral member 9 when the cap is rotated in the unscrewing direction.

The function of the lower ratchet mechanism 70 is as follows. If the ratchet mechanism 70 is not provided, the spiral member 9 may be rotated even during rotation of the cap 4 in the screwing direction, due to a phenomenon known a "dragging" occurring in the upper ratchet mechanism. Such a rotation of the spiral member 9 causes the solidified makeup liquid component to be scraped upward in the container body 1. In consequence, if the container body 1 is laid horizontally or if the amount of the makeup liquid remaining in the container body 1 is very small, the scraped solid component of the makeup liquid is deposited again onto the inner surface of the container body without being dissolved in the makeup liquid. The lower ratchet mechanism 70, however, effectively overcomes this problem because it can present the rotation of the spiral member 9 without fail when the cap 4 is being rotated in the screwing direction.

The provision of the lower ratchet mechanism 70, however, is not essential. Namely, when the makeup liquid has a high viscosity, there is no risk for the spiral member 9 to be rotated by the dragging in the upper ratchet mechanism, so that the lower ratchet mechanism can be dispensed with.

As will be seen from FIG. 27, the rotatable cylinder 7 has a saucer-shaped member, which is provided at its upper portion with a flange 85 extending outwardly therefrom. The saucer-shaped member also has a downward skirt suspending downward from the lower end thereof and claw members 86, 86 which project in the circumferential direction. Claws 32*b*,32*b* for the ratchet mechanism 32 are provided on the free ends of these claw members 86, 86. A polygonal or square hole 7*a* formed in the bottom wall of the rotatable cylinder 7 fits around the portion of the applicator shaft 5 having a polygonal or square shape so that the applicator shaft 5 is allowed to move up and down relative to the rotatable cylinder 7 but is prevented from rotating relative thereto. The rotatable cylinder 7 fits in the ring member 41 with its flange 85 resting on the top surface of the ring member 41 so as not to move downward therefrom.

The ratchet mechanism 32 is capable of transmitting torque only when the cap 4 is rotated in the unscrewing direction and does not transmits torque when the cap 4 is rotated in the screwing direction. Therefore, when the cap 4 is rotated in the screwing direction, the spiral member 9 is kept stationary due to resistance provided by the ratchet, mechanism 70 or the makeup liquid itself, though the rotatable cylinder 7 rotates in the same direction as the cap 4. Conversely, when the cap 4 is rotated in the unscrewing direction, the rotation of the applicator shaft 5 is transmitted to the spiral member 9 through the rotatable cylinder 7, whereby the spiral member 9 performs scraping action to scrape any component of makeup liquid off the inner surface of the barrel portion 8 of the container body 1. In this state, the lower ratchet 70 is maintained in a freed state so as not to impede the rotation of the spiral member 9.

In this embodiment, the engagement between the applicator shaft 5 and the rotatable cylinder 7 may be attained in various forms, provided that the arrangement allows the applicator shaft 5 to move up and down relative to the rotatable cylinder 7 while preventing relative rotation therebetween, though the illustrated embodiment employs the engagement between the applicator shaft having a polygonal cross-section and a mating hole formed in the bottom wall of the rotatable cylinder 7.

As has been described, in the twelfth embodiment of the present invention, a rotatable cylinder 7 is splined to the applicator shaft 5 which rotates in one and the other directions when the cap 4 is rotated in the screwing and unscrewing directions, and a spiral member 9 capable of scraping makeup liquid component on the inner surface of the barrel portion 8 of the container body 1 is rotatably disposed in the container body such that the spiral member 9 is rotated through the ratchet mechanism 32 only when the cap 4 is rotated in the unscrewing direction. Therefore, scraping of the makeup liquid component on the inner surface of the barrel portion 8 of the makeup liquid container is effected simultaneously with the unscrewing and removal of the cap 4, whereby the operation is facilitated and can be conducted without fail. It would be possible to provide the saw-teeth 32a of the ratchet mechanism 32 on the inner peripheral surface of the barrel portion 8 of the container body 1, so that the thickness of the barrel portion 8 and, hence, the diameter increase, with a result that the assembly is complicated. In this embodiment, the ratchet mechanism 32 is provided between the spiral member 9 independent from the barrel portion 8 and the rotatable member 7, so that the above-described inconvenience can be eliminated.

Thirteenth to fifteenth embodiments will be described with reference to FIGS. 28 to 37.

These embodiments employs a stirrer 9, 91 which may be a spiral member 9 rotatably received in the barrel portion 8 of the container body 1 and a rotatable bottom member 111 rotatably and liquid-tightly fitting in the barrel portion 8 so as to provide a bottom of the container body 1, the rotatable bottom 111 being exposed from the lower end opening of the barrel portion 8 of the container body 1 so as to be used as a rotary actuator. Alternatively, the rotary actuator is constituted by a bottom cap 112 secured to the exposed portion of the rotatable bottom 111.

Figure 28:
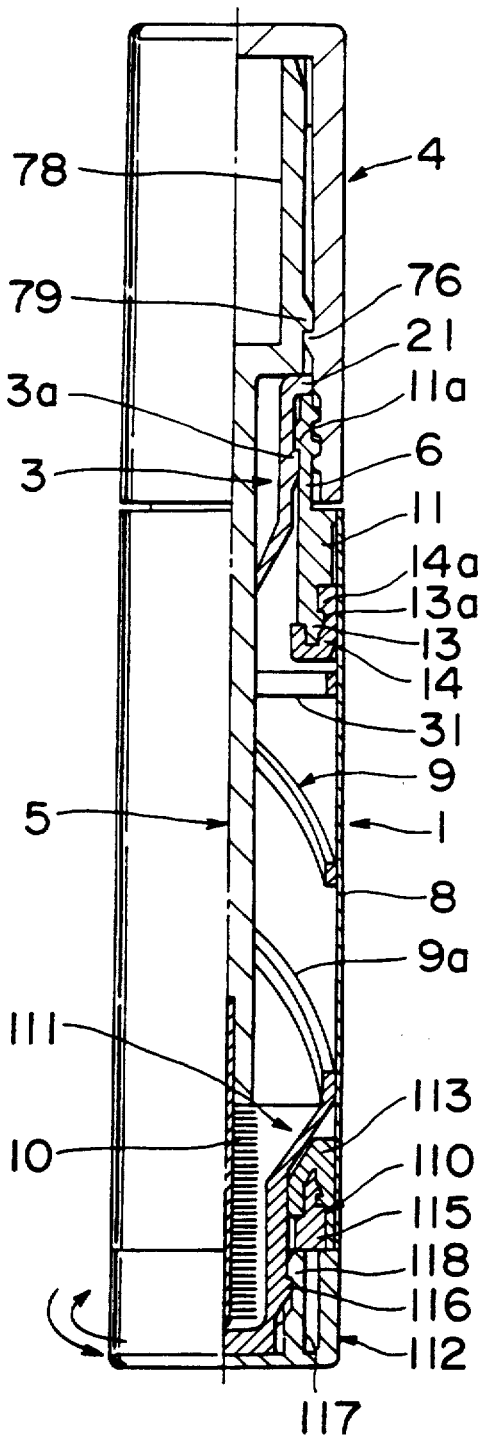
FIG. 28 is an elevational view of a thirteenth embodiment of the makeup liquid container with applicator in accordance with the present invention, with a half part thereof shown in section.
Figure 29:
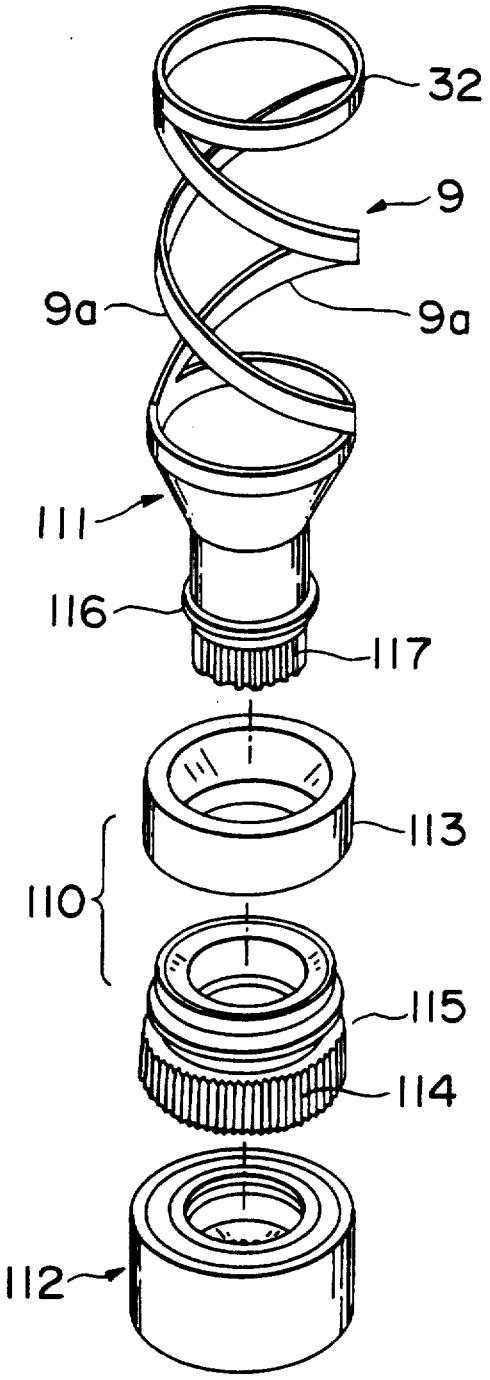
FIG. 29 is an exploded perspective view of an essential portion of the thirteenth embodiment.

The thirteenth embodiment will be described with reference to FIGS. 28 and 29.

The makeup liquid container of the thirteenth embodiment has barrel portion 8 which is provided with an open neck portion 6 on an upper portion thereof. The barrel portion 8 is further provided with a retainer ring 110 fitted on the inner peripheral edge of the lower opening thereof and having an upper surface which is tapered downward towards the center thereof. The makeup liquid container further has a rotatable bottom member 111 of a bottom-equipped funnel-like form. The rotatable bottom member 111 is fitted in the lower opening of the barrel portion 8 rotatably and in a liquid-tight manner so as to constitute the bottom of the container. The rotatable bottom member 111 has a spiral member 9 extending upward from the upper surface of the bottom member 111 and received in the barrel portion 8 so as to make a sliding contact with the inner surface of the barrel portion 8. The container further has a squeezing sleeve 3 fitted inside the open neck portion 6, a cap 4 screwed to the external surface of the open neck portion 6, and an applicator shaft 5 which extends downward from the cap 4 into the container body through the squeezing sleeve 3, and an applicator 10 such as a brush secured to the lower end of the applicator shaft 10. Preferably, a bottom cap 112 is provided so as to fit on the outer surface of the portion of the rotatable bottom member 111 exposed downward from the lower end of the barrel portion 8.

In the use of the makeup liquid, the user unscrews the 4 to remove it from the container body and pulls it upward so as to extract the applicator shaft 5 integral with the cap 4. During the extraction, the applicator shaft 5 and the applicator 10 are made to forcibly pass through the squeezing sleeve 3 so that the squeezing sleeve 3 wipes off any makeup liquid off the outer surface of the applicator shaft 5 and squeezes the applicator 10 so as to optimize the amount of the makeup liquid held by the applicator 10.

In order to scrape makeup liquid off the inner surface of the container body 1 as required, the user grasps the bottom cap 112 and rotates it in one and the other directions as indicated by arrows. As a result, the spiral member 9 slides on the inner surface of the barrel portion 8 of the container body 1 so a to scrape any makeup liquid off the inner surface of the barrel portion 8 of the container body 1. The rotation of the spiral member 9 also causes the makeup liquid in the container body 1 to be stirred, whereby solidification of the makeup liquid is avoided.

The thirteenth embodiment will be described in more detail with reference to FIGS. 28 and 29.

The makeup liquid container 1 of this embodiment has a barrel portion 8 made of a decorative metallic material and a mouth member 11 fitted in the upper open end of the barrel portion 8 and provided with an open neck portion 6. The open neck portion 6 is externally threaded and is provided with an engaging ridge 112 projecting from the inner peripheral surface thereof. The lower portion of the mouth member 11 has a mounting peripheral wall 13 having an engaging ridge 13a projecting therefrom. An elastic ring member 14 having a portion exhibiting a substantially U-shaped cross-section has an engaging ridge 14a. The elastic ring member 14 fits on the lower side of the mounting peripheral wall 13 in such a manner as to cover the underside of the mounting peripheral wall 13, with the engaging ridge 14a thereof engaging with the aforementioned engaging ridge 13a. This elastic ring member 14 serve as a liquid-tight seal member and functions also as a buffer member. A multiplicity of vertical grooves are formed in the inner surface of the barrel portion 8 at lower portion of the latter.

The retainer ring 110 in the lower end of the barrel portion 8 is a composite member composed of an upper member 113 which makes a liquid-tight contact with the inner surface of the barrel portion 8 and a lower member 115 fitted to the upper member 113. The lower member 115 is provided in the outer surface thereof with a multiplicity of vertical ridges 114 fitting in the vertical grooves formed in the inner peripheral surface of the barrel portion 8. The upper member 113 has a tapered top surface.

The rotatable bottom member 111 has a bottom-equipped funnel-like form and is liquid-tightly and rotatably fitting in the lower end opening of the barrel portion 8 with its conical portion engaging with the conical surface of the retainer ring 110. An engaging rib 116 is formed on a lower portion of the rotatable bottom member 111 projecting downward from the lower end opening of the barrel portion 8 A multiplicity of vertical ridges 117 are formed on the outer surface of the lower end of the rotatable bottom member 111. Spiral strings 9a, 9a are provided to extend upward from opposite sides of the top surface of the rotatable bottom member 111 for sliding engagement with the inner surface of the barrel portion 8 of the container body 1. A ring 31 is connected to the upper ends of these spiral strings 9a, 9a.

The squeezing sleeve 3 is made of a soft elastic material such as a rubber or a soft synthetic resin and is provided at the upper end thereof with an outward flange 21 which is adapted to rest on the top of the open neck portion 6. The squeezing sleeve 3 also is provided on the outer peripheral surface thereof with an engaging ridge 3a for engagement with the engaging ridge 11a on the open neck portion 6. The lower end of the squeezing sleeve 3 forms a restricted opening the wall of which makes resilient contact with the applicator shaft 5.

The cap 4 is provided with a screw thread in the inner peripheral surface at a lower portion thereof and an engaging ridge 76 projecting from the inner peripheral surface thereof at a portion immediately above the thread.

The applicator shaft 5 has a cylindrical upper end portion 78 which fits in the peripheral wall of the cap 4. At the same time, an engaging ridge 79 on the outer surface thereof engages with the aforementioned engaging ridge 76. The applicator shaft 5 extends downward through the squeezing sleeve 3. A brush or a similar applicator 10 is fixed to the lower end of the applicator shaft 5. The applicator 10 is received in a bore formed in the bottom member 111.

The bottom cap 112 is a deep-saucer-shaped member having a double peripheral wall, and is provided on the upper part of the inner surface of the peripheral wall 117 with an engaging ridge 118 which engages with the aforementioned engaging ridge 116. The bottom cap 112 is further provided at its lower portion with a plurality of vertical grooves formed in the inner peripheral surface thereof for engagement with the vertical ridges 117. The bottom cap 112 is fixedly fitted on the lower outer surface of the rotatable bottom member 111.

The components the materials of which are not specifically mentioned may be formed by molding from a synthetic resin.

As will be understood from the foregoing description, according to the present invention, the bottom portion of the container body 1 is constructed as a rotatable bottom member 111 which is separate from the barrel portion 8 and which is rotatable relative to the barrel portion 8, and a spiral member 9 capable of making sliding contact with the inner peripheral surface of the barrel portion is formed to protrude upright from the rotatable bottom member 111. It is therefore possible to scrape makeup liquid off the inner peripheral surface of the barrel portion 8 of the container body 1 by rotating the rotatable bottom member 111 as desired. The bottom member 111 can be designed as to restrict the internal volume of the container body 1 to such an extent as to just receive the applicator 10, whereby the amount of makeup liquid remaining in the container body without being used is minimized. The shape of the bottom cap 112 is not essential provided that the rotatable bottom member 111 rotatably and liquid-tightly fits in the bottom opening of the barrel portion 8 and that the rotatable bottom member 112 projects downward from the lower opening of the barrel portion 8 in such a length as to enable the user to easily rotate the rotatable bottom member 112 with respect to the barrel portion 8.

Fourteenth and fifteenth embodiments of the present invention will be described with reference to FIGS. 30 to 37. These embodiments have, besides the features explained in connection with FIGS. 28 and 29, a ratchet mechanism which enables the spiral member to rotate only when the bottom cap is rotated in a predetermined direction.

The makeup liquid containers of these embodiments have a container body 1 having a barrel portion 8 and an open neck portion, a cap 4 screwed onto the open neck portion of the container body 1, an applicator shaft 5 having an applicator 10 fixed to the lower end thereof and extended downward into the container body 1, wherein the lower end of the barrel portion 8 is opened so as to rotatably and liquid-tightly receive a rotatable bottom member 111 which constitutes the bottom of the container body, and a bottom cap 112 is integrally fixed to the rotatable bottom member 111, the rotatable bottom member 111 being provided with a spiral member 9 disposed in the barrel portion 8 and having spiral strings 9a held in sliding contact with the inner surface of the barrel portion 8. In addition, a ratchet mechanism 32 is provided between the barrel portion 8 and the bottom cap 112 such as to allow the bottom cap 112 to rotate only in a positive direction relative to the barrel portion 8. The direction of the spiral form of the spiral string 9a is so determined that, when the spiral member 9 is rotated by the rotation of the bottom cap 112 in the positive direction, the spiral strings 9a scrapes depositing matters off the inner surface of the barrel portion 8 downwards toward the bottom of the container body.

Figure 30:
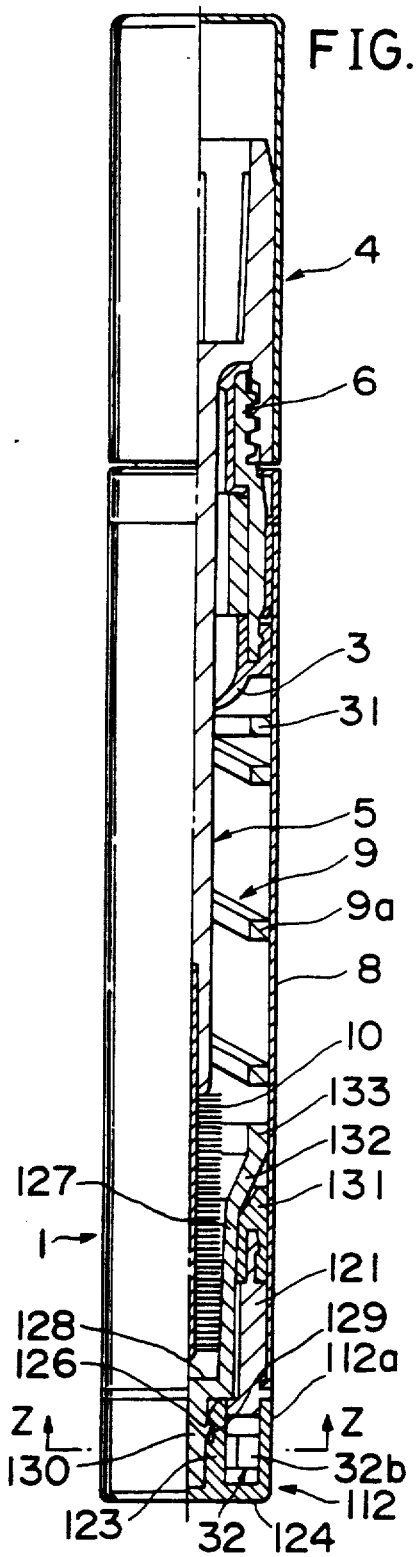
FIG. 30 is an elevational view of a fourteenth embodiment of the makeup liquid container with applicator in accordance with the present invention, with a half part thereof shown in section.

When the bottom cap 112 is rotated from the position of FIG. 30 in the positive direction, i.e., clockwise as viewed from the bottom of the container body, the spiral member 9 also is rotated in the same direction so that the spiral strings 9a,9a contacting the inner surface of the barrel portion 8 scrapes the deposited matters off the inner surface downward towards the bottom of the container body. The ratchet mechanism 32 provided between the barrel portion 8 and the bottom cap 112 prevents the spiral strings 9a, 9a from rotating in such a direction as to move the deposited matters upward.

The fourteenth embodiment will be described in more detail.

The makeup liquid container of the fourteenth embodiment has an elongated container body having a barrel portion 8 and an open neck portion 6 projecting upright therefrom. A squeezing sleeve 3 for optimizing the amount of the makeup liquid held by the applicator 10 is fixed in an upper portion of the container body.

Figure 31:
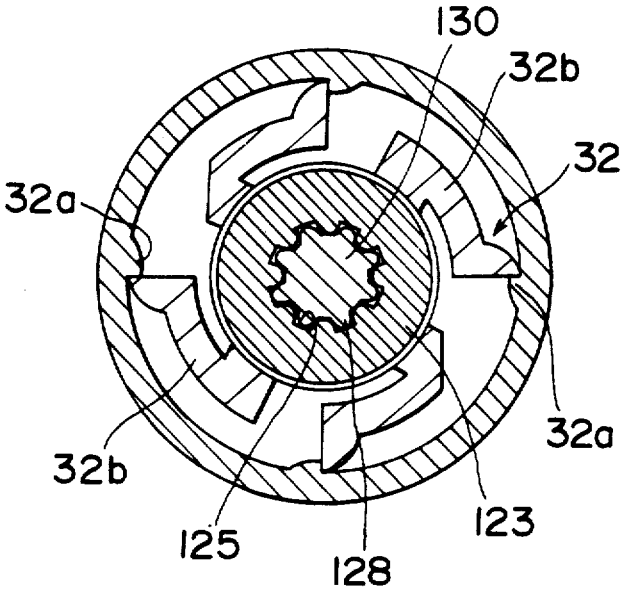
FIG. 31 is a cross-sectional view taken along the line Z—Z of FIG. 30.
Figure 33:
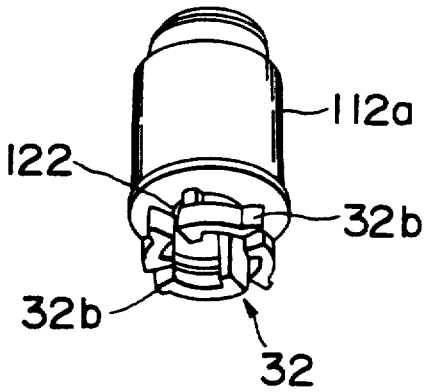
FIG. 33 is a perspective view of a connecting cylinder used in the container body in the fourteenth embodiment.

The lower end of the barrel portion 8 is opened so as to rotatably receive the outer peripheral wall 112a of a bottom cap 112. A ratchet mechanism 32 is provided between the lower end of the barrel portion 8 and the bottom cap 112 such as to allow the bottom cap 112 to rotate only in positive direction which is usually clockwise direction relative to the barrel portion 8. In the illustrated case, a connecting cylinder 121 is fitted in the open lower end of the barrel portion 8 and a plurality of supporting legs 122 are suspended from the lower end of the connecting cylinder 121. As shown in FIGS. 31 and 33, claws 32b are connected at their base ends to the lower ends of the supporting legs 122 such that the ends of the claws 32b engage with the engaging ridges 32a formed on the inner surface of the outer peripheral wall 112a of the cap 112. When the outer peripheral wall rotates in the positive direction relative to the barrel portion, the ends of the claws are deflected inward so as to be kept out of engagement with the engaging ridges 32a. However, when the peripheral wall is rotated in the counter direction, i.e., counterclockwise as viewed in FIG. 31, the claws 32b engage with the engaging ridges 32a so as to prevent the rotation of the peripheral wall. The illustrated construction of the ratchet mechanism 32b is only illustrative. For instance, the engaging ridges 32a may be provided on the outer surface of the inner peripheral wall. The claws 32b may be substituted by saw-teeth-shaped ratchet teeth.

The inner peripheral wall 123, which protrudes upright from the bottom wall 124 of the bottom cap 4, is provided at the inner surface thereof with a plurality of vertical grooves 125 as shown in FIG. 31. Second vertical grooves 126 are formed in upper portion of the inner surface of the inner peripheral wall 123.

Figure 32:
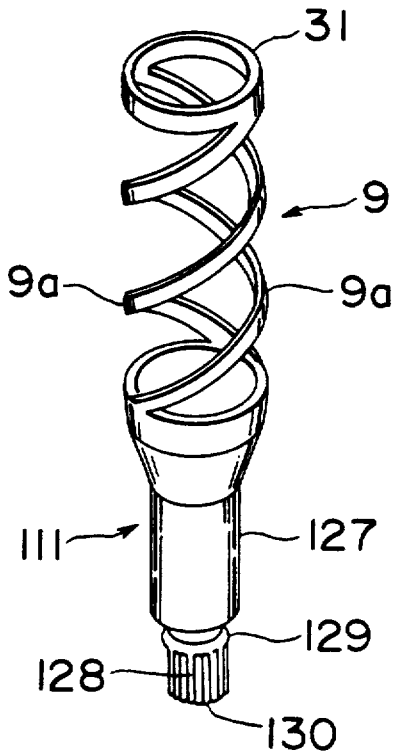
FIG. 32 is a perspective view of a rotatable cylinder used in the container body in the fourteenth embodiment.
Figure 34:
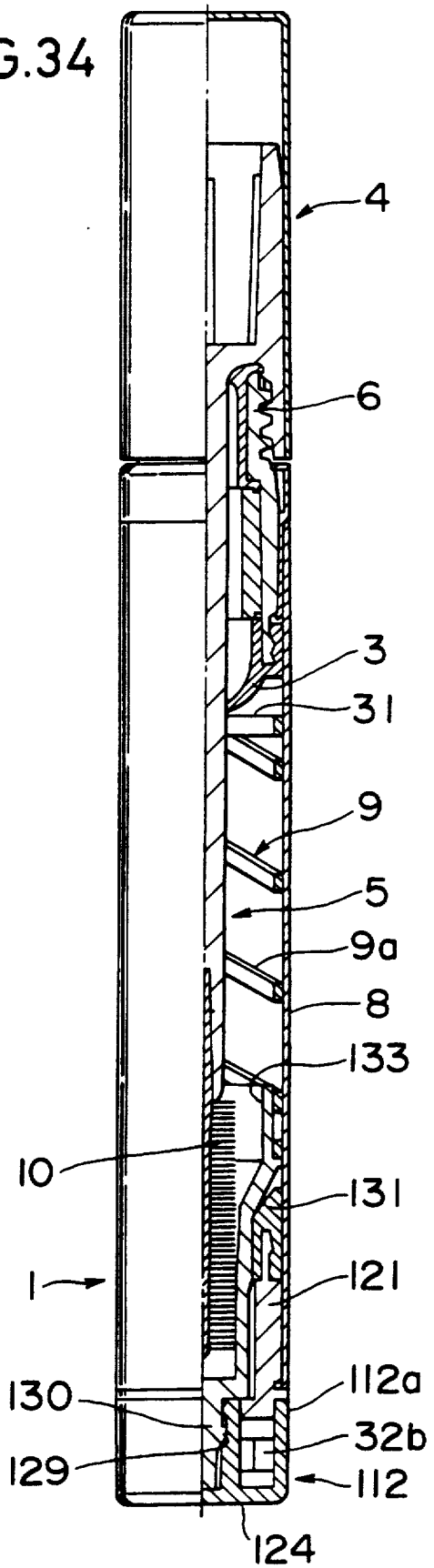
FIG. 34 is an elevational view of a fifteenth embodiment of the makeup liquid container with applicator in accordance with the present invention, with a half part thereof shown in section.
Figure 35:
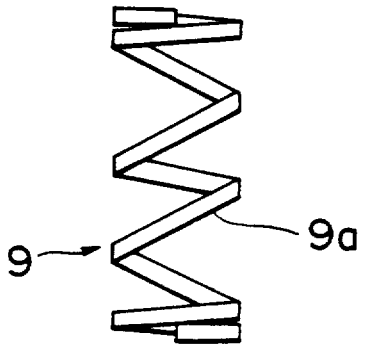
FIGS. 35 and 36 are front elevational views of different forms of a spiral cylindrical member.
Figure 36:
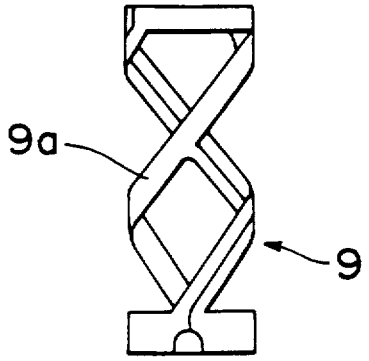
Figure 37:
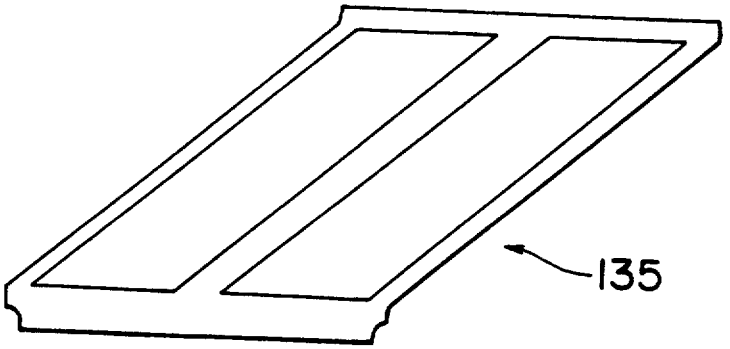
FIG. 37 is a perspective view of a sheet blank from which the spiral cylindrical member is punched out.

A rotatable bottom member 111, which constitutes the bottom of the container body 1, is rotatably and liquid-tightly fitted in the lower end opening of the barrel portion 8. The rotatable bottom member 111 has a small cylindrical portion 127 from the lower end of which is extended a connecting rod 130 which is provided with first ridges 128 and second ridges 129 capable of engaging with the first and second grooves 125 and 126. The rotatable bottom member 112 is rotatable together with the bottom cap 112 with respect to the barrel portion 8 of the container body 1. The small cylindrical portion 127 having a bottom is received in the aforementioned connecting cylinder 121 and also in a seal cylinder 131 which fits in the upper end of the connecting cylinder 121. A large-diameter portion 133 is formed to stand upright from the upper end of the small cylindrical portion 127 through a tapered portion 132 and, as shown in FIG 32, a pair of spiral strings 9a, 9a are made to stand upright from the upper end of the larger diameter portion 133. A ring 31 is connected to the upper ends of the spiral. The spiral strings 9a, 9a and the ring 31 constitute a spiral member 9. The spiral member 9 is disposed in the barrel portion 8 such that it makes a sliding contact with the inner surface of the barrel portion 8. The direction of the spiral form of the spiral strings 9a, 9a is so determined that they scrape the makeup liquid on the inner surface of the barrel portion 8 downward when the bottom cap 112 is rotated in the positive direction with respect to the barrel portion 8. If the positive direction is the clockwise direction, the direction of winding of the spiral form of the spiral strings 9a, 9a also is clockwise when viewed in the same direction. As shown in FIG. 34, the spiral member 9 may be constructed as a separate member and connected to the rotatable bottom member 111. FIGS. 35 and 36 show spiral members 9 which are formed separately while 135 denotes a sheet blank 135 from which the spiral member 9 is to be punched out. A reference numeral 4 denotes a cap which is screwed to the open neck portion 6 of the container body. An applicator shaft 5 having an applicator 10 fixed to the lower end thereof is extended downward from the cap 4. The applicator 10, which is typically a brush, is fitted in a bore formed in the small cylindrical portion 127.

Since the bottom cap 112 fitting in the lower end portion of the barrel portion of the container body is rotatable only in the positive direction, so that the spiral strings 9a, 9a of the spiral member 9 also are rotated in the same direction so as to scrape deposited matters downward towards the bottom of the container body 1, whereby the scraped matters are dissolved again in the makeup liquid. At the same time, the spiral member 9 which is rotated by the rotation of the bottom cap 112 causes the makeup liquid in the container body to be stirred, whereby solidification of the makeup liquid is prevented.

What is claimed is:

1. A makeup liquid container with an applicator comprising:

a container body having a barrel portion and an open neck portion;

a cap capable of being screwed to the outer surface of said open neck portion;

a squeezing sleeve fitted in said open neck portion;

an applicator shaft extended downward from said cap into said barrel portion through said squeezing sleeve;

a stirrer disposed rotatably about the longitudinal axis of said barrel portion and in continuous sliding contact with the inner surface of said barrel portion so as to scrape makeup liquid from a portion of said inner surface, said portion of said inner surface including at least two points separated from each other in at least said longitudinal direction; and rotary actuating means for rotationally actuating said stirrer and exposed from the bottom of said barrel portion of said container body.

2. A makeup liquid container with an applicator according to claim 1, wherein said stirrer includes a spiral member rotatably disposed in said barrel portion in sliding contact with the inner surface of said barrel portion and fixed to a rotational bottom member which is rotatably and liquid-tightly received in said barrel portion, and said rotary actuating means includes a bottom cap rotatably fitted in the lower end opening of said barrel portion and engaging with said rotatable bottom member.

3. A makeup liquid container with an applicator according to claim 2, further comprising a ratchet mechanism provided between said bottom cap and aid barrel portion.

4. A makeup liquid container with an applicator according to claim 2, wherein said barrel portion has a retainer ring fitting in the lower end opening of said barrel portion and having a concaved conical surface, and wherein said rotary actuating means includes a rotatable bottom member rotatably and liquid-tightly fitted in the lower end opening of said barrel portion through the intermediary of said retainer ring, said stirrer including a spiral scraping blade protruding upright from the upper surface of said rotatable bottom member and received in said barrel portion in sliding contact with the inner surface of said barrel portion.

5. A makeup liquid container with an applicator according to claim 4, further comprising a ratchet mechanism provided between said bottom cap and said barrel portion.

6. A makeup liquid container with an applicator according to claim 1, wherein said barrel portion has a retainer ring fitting in the lower end opening of said barrel portion and having a concaved conical surface, and wherein said rotary actuating means includes a rotatable bottom member rotatably and liquid-tightly fitted in the lower end opening of said barrel portion through the intermediary of said retainer ring, said stirrer including a spiral scraping blade protruding upright from the upper surface of said rotatable bottom member and received in said barrel portion in sliding contact with the inner surface of said barrel portion.

7. A makeup liquid container with an applicator according to claim 6, further comprising a ratchet mechanism provided between a bottom cap fixed to said rotatable bottom member and capable of allowing said bottom cap to rotate only in a positive direction relative to said barrel portion 3 said stirrer having a spiral member making sliding contact with the inner surface of said barrel portion and having such a spiral form that said spiral member scrapes matter deposited on the inner surface of said barrel portion downwardly when said bottom cap is rotated in the positive direction.

* * * * *